US008060959B2

(12) United States Patent
Thorne et al.

(10) Patent No.: US 8,060,959 B2
(45) Date of Patent: Nov. 22, 2011

(54) FOLDABLE CHILD ENCLOSURE

(75) Inventors: Henry F. Thorne, West View, PA (US); Robert D. Daley, Pittsburgh, PA (US)

(73) Assignee: Thorley, Industries, Pittsburgh, PA (US)

( * ) Notice: Subject to any disclaimer, the term of this patent is extended or adjusted under 35 U.S.C. 154(b) by 0 days.

(21) Appl. No.: 12/906,605

(22) Filed: Oct. 18, 2010

(65) Prior Publication Data

US 2011/0031457 A1 Feb. 10, 2011

Related U.S. Application Data

(63) Continuation of application No. 12/030,634, filed on Feb. 13, 2008, now Pat. No. 7,836,530, and a continuation-in-part of application No. 11/675,098, filed on Feb. 15, 2007, now Pat. No. 7,661,156.

(60) Provisional application No. 60/889,922, filed on Feb. 14, 2007, provisional application No. 60/889,924, filed on Feb. 14, 2007, provisional application No. 60/889,925, filed on Feb. 14, 2007, provisional application No. 60/889,928, filed on Feb. 14, 2007, provisional application No. 60/889,940, filed on Feb. 15, 2007, provisional application No. 60/889,941, filed on Feb. 15, 2007, provisional application No. 60/889,942, filed on Feb. 15, 2007, provisional application No. 60/889,943, filed on Feb. 15, 2007, provisional application No. 60/890,058, filed on Feb. 15, 2007, provisional application No. 60/889,983, filed on Feb. 15, 2007, provisional application No. 60/889,989, filed on Feb. 15, 2007, provisional application No. 60/889,995, filed on Feb. 15, 2007, provisional application No. 60/890,004, filed on Feb. 15, 2007, provisional application No. 60/890,012, filed on Feb. 15, 2007, provisional application No. 60/890,026, filed on Feb. 15, 2007.

(51) Int. Cl.
*A47C 7/00* (2006.01)

(52) U.S. Cl. ..... 5/99.1; 5/93.1

(58) Field of Classification Search ..... 5/99.1, 5/98.1, 93.1, 98.3
See application file for complete search history.

(56) References Cited

U.S. PATENT DOCUMENTS

| | | | |
|---|---|---|---|
| 2,670,477 | A | 3/1954 | Pond |
| 2,825,071 | A | 3/1958 | Landry et al. |
| 3,119,124 | A | 1/1964 | Krauss |
| 3,206,773 | A | 9/1965 | Sarasin |
| 3,309,718 | A | 3/1967 | Sarasin |
| 3,430,273 | A | 3/1969 | Stillwaugh |
| 3,848,278 | A | 11/1974 | Propst |
| 4,811,437 | A | 3/1989 | Dillner et al. |
| 4,819,285 | A | 4/1989 | Fetters |

(Continued)

*Primary Examiner* — Fredrick Conley

(57) ABSTRACT

A child enclosure apparatus that includes a hub assembly, a base assembly having four base legs in an X-shaped configuration, a side structure having four side posts, an upper assembly having four pairs of upper arms with each pair connected with medial latch connectors, lower corner assemblies, each having a pair of plates that are pivotally mounted to a side post and a pair of base legs, upper corner assemblies, each having two pair of plates that are configured at a right angle to each other, and cables extending from the base assemblies, through the side posts and being connected to the upper arms and to the latch connectors. The enclosure apparatus is operated by linear movement of the hub assembly, either by a motor assembly or manually, to cause simultaneous movement of the base legs, the upper arms and the latch connectors between opened and folded positions by tensioning the cables. The lower corner assemblies are pivotally connected to the side posts and the base legs so as to prevent unintended opening of the enclosure from a folded position.

16 Claims, 39 Drawing Sheets

U.S. PATENT DOCUMENTS 4,837,875 A 6/1989 Shamie et al.
4,985,948 A 1/1991 Mariol
5,025,517 A 6/1991 Johnson
5,197,154 A 3/1993 Shamie
5,239,714 A 8/1993 Huang
5,241,716 A 9/1993 Kohus
5,243,718 A 9/1993 Shamie
5,279,006 A 1/1994 Teng
5,293,656 A 3/1994 Chan
5,353,451 A 10/1994 Hsiung
5,358,220 A 10/1994 Yu-Kuang
5,363,521 A 11/1994 Garland et al.
5,367,725 A 11/1994 Tsai
5,381,570 A 1/1995 Cheng
D359,869 S 7/1995 Oren
5,504,951 A 4/1996 Yeh
5,513,399 A 5/1996 Weng
5,530,977 A 7/1996 Wang
5,615,427 A 4/1997 Huang
5,809,592 A 9/1998 McAllister
5,867,851 A 2/1999 Mariol et al.
5,911,653 A 6/1999 Cheng
6,125,483 A 10/2000 Stroud et al.
6,256,814 B1 7/2001 Drobinski
6,317,907 B1 11/2001 Wang
6,336,234 B1 * 1/2002 Kuo ..... 5/99.1
6,343,390 B1 2/2002 Yang et al.
6,357,462 B1 3/2002 Laosunthara et al.
6,421,850 B1 7/2002 Welsh, Jr.
6,473,919 B1 11/2002 Wang
6,510,568 B1 1/2003 Drobinski et al.
6,634,038 B2 10/2003 Hsia
6,684,420 B2 2/2004 Koenig et al.
6,851,135 B1 2/2005 Chen
7,043,779 B2 5/2006 Mendenhall et al.
7,069,605 B2 7/2006 Harvey, III
7,343,634 B2 3/2008 Song
2003/0061657 A1 4/2003 Longenecker et al.
2006/0021137 A1 2/2006 Waldman et al.
2006/0021138 A1 2/2006 Waldman et al.
2006/0037137 A1 2/2006 Song
2006/0174406 A1 8/2006 Yang
2006/0185082 A1 8/2006 Casati Troutman
2006/0225204 A1 10/2006 Bretschger et al.
2006/0225208 A1 10/2006 Chen
2007/0017025 A1 * 1/2007 Myer ..... 5/99.1
2007/0157379 A1 7/2007 Lin
2007/0163041 A1 7/2007 Cheng et al.
2007/0277308 A1 12/2007 Chen et al.

* cited by examiner

FOLDABLE CHILD ENCLOSURE

CROSS REFERENCE TO RELATED APPLICATIONS

This application is a continuation of U.S. patent application Ser. No. 12/030,634 Filed: Feb. 13, 2008, which claims priority pursuant to 35 U.S.C. 119(e) to U.S. Provisional Application Nos. 60/889,922 Filed: Feb. 14, 2007, 60/889,924 Filed: Feb. 14, 2007, 60/889,925 Filed: Feb. 14, 2007, 60/889,928 Filed: Feb. 14, 2007, 60/889,940 Filed: Feb. 15, 2007, 60/889,941 Filed: Feb. 15, 2007, 60/889,942 Filed: Feb. 15, 2007, 60/889,943 Filed: Feb. 15, 2007, 60/890,058 Filed: Feb. 15, 2007, 60/889,983 Filed: Feb. 15, 2007, 60/889,989 Filed: Feb. 15, 2007, 60/889,995 Filed: Feb. 15, 2007, 60/890,004 Filed: Feb. 15, 2007, 60/890,012 Filed: Feb. 15, 2007, 60/890,026 Filed: Feb. 15, 2007, and which is a continuation-in-part of U.S. patent application Ser. No. 11/675,098 Filed: Feb. 15, 2007, all of which are incorporated herein by reference in their entirety.

BACKGROUND OF THE INVENTION

1. Field of the Invention

The present invention relates generally to a foldable child enclosure, such as a play yard, playpen, or crib apparatus, and, more particularly, to a child enclosure apparatus that is quick and easy to open for use and to fold for transport and/or storage and to do so either manually or with a motor.

2. Description of Related Art

Foldable play yards, playpens and crib devices are well known, as perhaps best exemplified by U.S. Pat. No. 4,811,437 for a "Foldable Playyard" to Dillner and Saint. The foldable device disclosed there is light in weight, and when collapsed, a fairly convenient compact package. One major problem with such devices, however, is that they are difficult to handle by being cumbersome to open and unwieldy to fold with clumsy operating mechanisms. Usually there is a need to pull up on a central lower mechanism and a need to unlatch upper rails also. Another device is shown in an application, Publication No. 2007/0017025, for a "Folding Play Yard" by Myer. There is a purported disclosure of a release mechanism that causes release means such as a cable to unlatch upper side members so that the play yard may go from a deployed to a folded condition. However, there is no disclosure concerning the movement of the play yard from the folded condition to a deployed condition. The release means play no part in such a movement. Furthermore, the lower structure of the disclosed play yard includes diagonal braces, as well as side members so that the play yard is complicated and heavy.

A more easily operated device that opens and folds smoothly is desirable, especially for those users doing so while attention is being directed to young children. An efficient, low weight and robust structure is also desirable.

SUMMARY OF THE INVENTION

In accordance with the present invention, an advantageous method and apparatus are provided in the form of a child enclosure that is especially designed to be easily and quickly operated both in opening and folding modes. Described embodiments include an apparatus that has a centrally located hub assembly connected to simultaneously move all of the movable components of the enclosure at the same time that the hub assembly moves. The invention also includes a lower corner structure that pivots slightly from a position when the enclosure apparatus is opened to another position when the enclosure is folded so that a tendency for the enclosure to swing partially open on it own is avoided. When opening, the enclosure includes upper arms that rotate upwardly passed horizontal positions before the arms settle back to their final horizontal positions. Operation of an embodiment includes the use of a sliding cam-follower plate that enables the correct geometric movement of various components of the enclosure. Latching connectors between upper arms in the enclosure upper assembly also contribute to superior operation of the inventive apparatus. Additionally, the enclosures may be operated either by hand or with a motor. All of these features are packaged in an efficient, relatively inexpensive and robust structure.

Briefly summarized, the invention relates to a foldable enclosure apparatus for a child comprising an upper assembly forming an upper portion of the enclosure, the upper assembly having arms and a latch, a base assembly connected to the upper assembly forming a lower portion of the enclosure, an operative structure connected to the base assembly, and a set of cables connected to the upper arms and to the latch to move the upper arms and the latch to positions consistent with an opened enclosure and to positions consistent with a folded enclosure in response to movement of the operative structure. The invention also relates to a method for constructing a foldable child enclosure apparatus comprising the steps of forming a frame including a hub assembly, a base assembly, a side structure and an upper assembly, locating the hub assembly in a central location, and connecting the base assembly to the upper assembly with a cable wherein the cable causes the upper assembly to open and fold in response to upward and downward linear motion of the hub assembly.

BRIEF DESCRIPTION OF THE DRAWINGS

For the purpose of facilitating an understanding of the invention, the accompanying drawings and description illustrate preferred embodiments thereof, from which the invention, its structures, its construction and operation, its processes, and many related advantages may be readily understood and appreciated.

DESCRIPTION OF THE PREFERRED EMBODIMENTS

The following description is provided to enable those skilled in the art to make and use the described embodiments set forth in the best modes contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
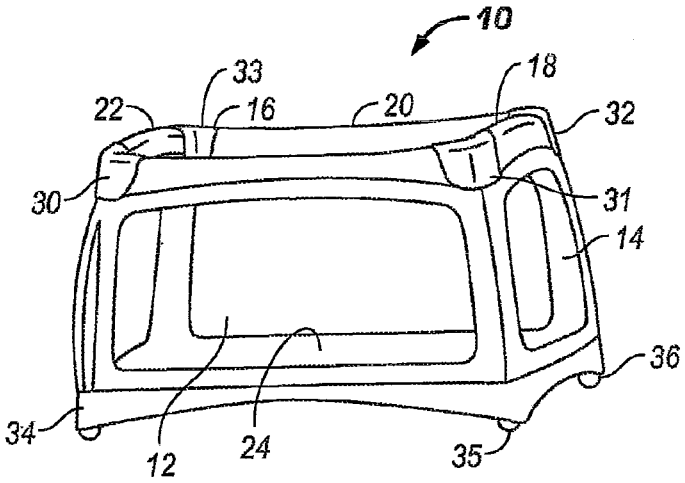
FIG. 1 is an isometric view of a preferred embodiment of a play yard enclosure shown in an opened or deployed position.
Figure 2:
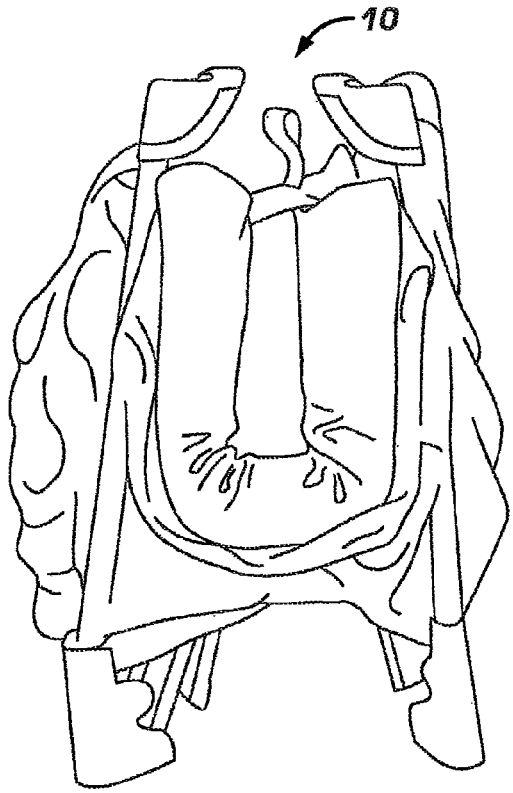
FIG. 2 is an isometric view of the play yard shown in FIG. 1, in a folded or closed position.

An embodiment of the invention is shown in FIGS. 1 and 2, in the form of a foldable child enclosure apparatus 10 configured in the form of a play yard, or playpen, and also useable as a crib. The play yard is portable, and as such, is foldable, closable or collapsible so as to move between an opened, deployed position as graphically shown in FIG. 1, for use, and a folded, collapsed or closed position as graphically shown in FIG. 2, for transport and/or storage. The play yard may have soft, flexible mesh sides, such as sides 12, 14, fabric coverings, such as fabric coverings 16, 18, 20, 22, a base pad or mattress 24, and decorative and protective upper and lower corners, such as the four upper corners 30, 31, 32, 33, and the four lower corners, of which only three lower corners 34, 35, 36 are shown. Side padding (not shown) may also be placed around the interior of the play yard for added protection of a child placed on the pad or mattress 24. Storage devices, child seats, bassinets and the like may also be mounted on and to the play yard although they are not shown here. Under the mesh, the fabric, the pad and any side padding is a foldable frame 40, as shown in an opened position in FIG. 3, and in a folded position in FIG. 4.

Figure 3:
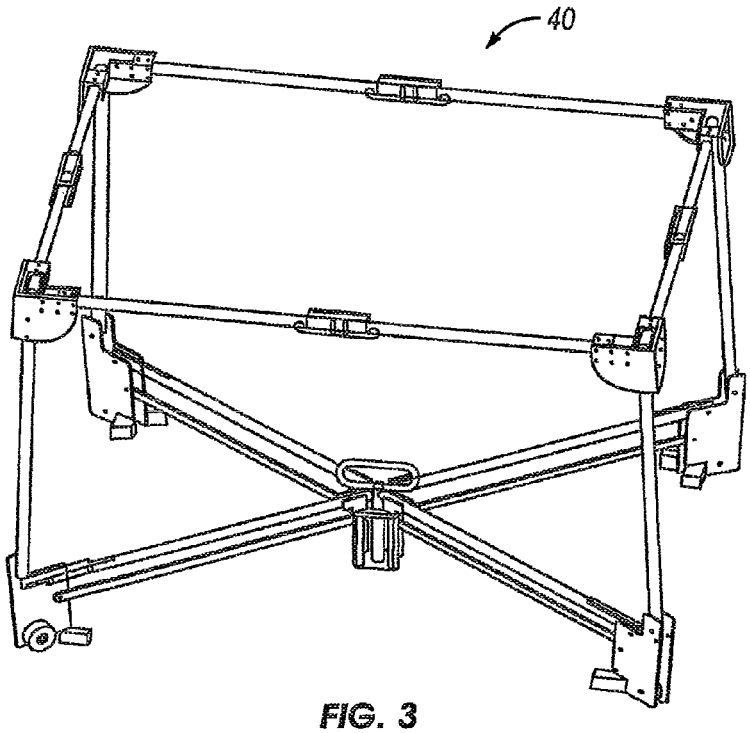
FIG. 3 is an isometric view of a frame of the play yard shown in FIGS. 1 and 2 in an opened position.
Figure 5:
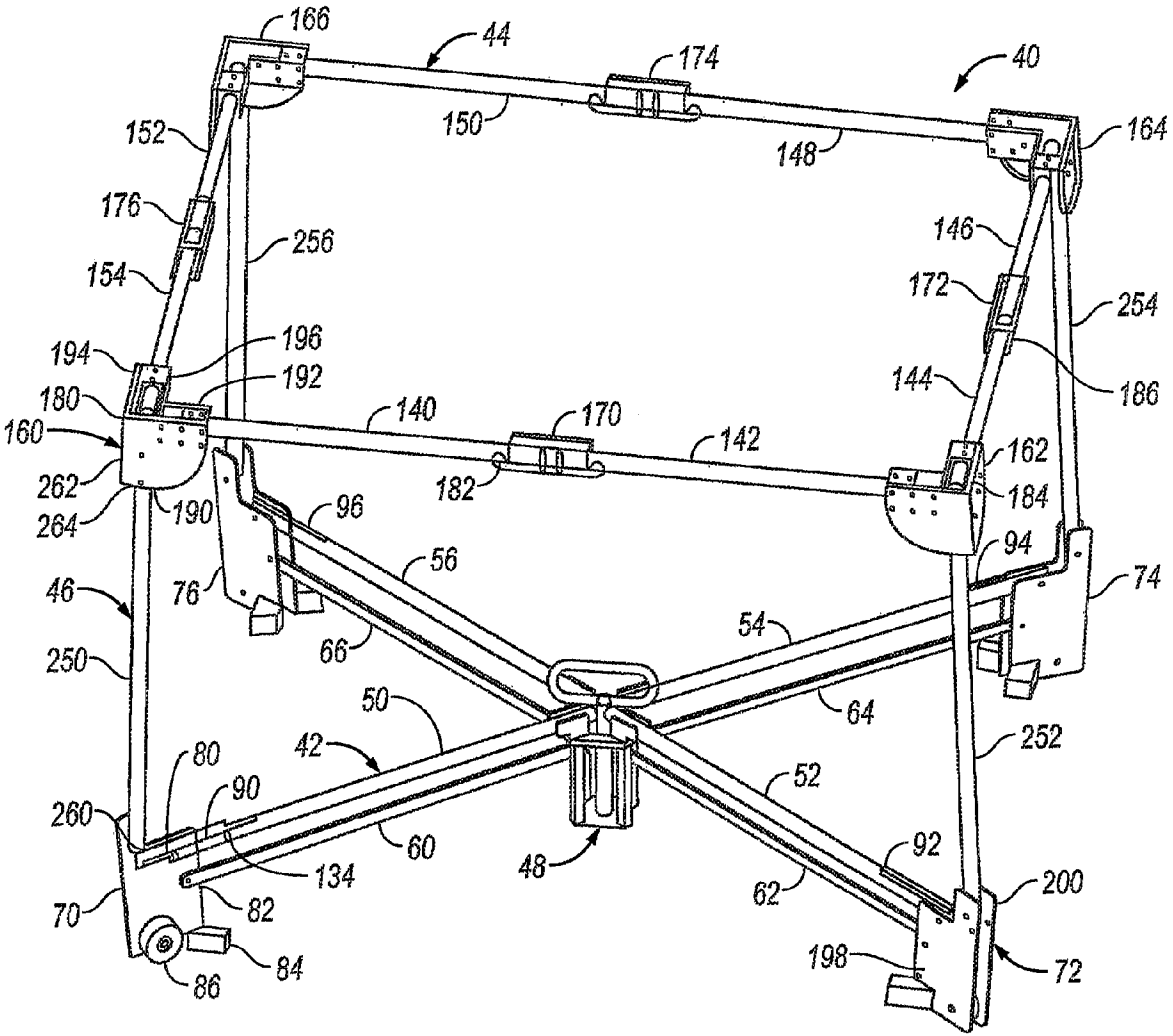
FIG. 5 is an enlarged isometric view of the opened frame shown in FIG. 4.

To better understand the invention, the detailed description of the frame set forth herein may best be understood by dividing the frame into four portions, and by reference to FIG. 5, an enlarged view of FIG. 3. The frame includes a base assembly 42 forming a lower portion of the frame, an upper assembly 44 forming an upper portion of the frame, a side structure 46, and a centrally located hub assembly 48. The base assembly 42 is pivotally connected to both, the hub assembly 48 and to the side structure 46, and the upper assembly 44 is pivotally connected to the side structure 46.

The base assembly 42 includes four upper base legs 50, 52, 54, 56, and four lower base legs 60, 62, 64, 66, four corner assemblies 70, 72, 74, 76, and pivot rivets, such as the rivets 80, 82 around which the upper base leg 50 and the lower base leg 60 pivot or rotate relative to the corner assembly 70. (The corner assembly 70 is shown with a missing side plate to allow a better view of the base legs and the locations of the pivots for the legs, such as the locations of the rivets 80 and 82.) Each quarter of the frame is constructed in the same manner so that only the left portion of the frame as shown in FIG. 5 will be detailed. The base legs are configured as shown in an "X" pattern and no side structure or elements are present as in many earlier play yards. The corner assemblies each include a pair of abutment blocks, such as the abutment block 84, and a wheel or caster, such as the wheel 86. Each upper base leg has mounted to it a cam-follower slider 90, 92, 94, 96.

Figure 6:
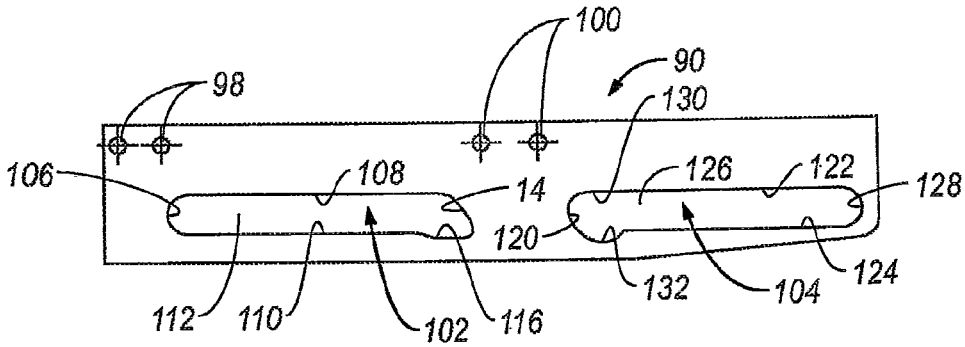
FIG. 6 is an enlarged elevation view of a cam-follower plate of the frame shown in FIG. 5.

Each cam-follower slider, such as the slider 90, FIG. 6, has two series of upper holes 98, 100 and two cam-follower slots 102, 104. The left most cam-follower slot 102, as viewed in FIG. 6, includes a circular left end portion 106, parallel upper and lower edges 108, 110 along a middle portion 112, and a specially shaped right end portion 114. The right end portion includes a drop in a lower edge 116 so as to be enlarged with a recess when compared to the left end portion 106. The right hand slot 104 includes a specially shaped left end portion 120, parallel upper and lower edges 122, 124 along a middle portion 126, and a circular right end portion 128. The left end portion 120 of the right slot 104 includes an upper edge 130 that is linear with the upper edge 122 of the middle portion, and a lower edge 132 that is recessed when compared to the lower edge 124 of the middle portion. The rivet 80, FIG. 5, acts as a cam in the left hand slot 102 and also pivotally connects the upper base leg 50 to the lower corner assembly 70. Another rivet 134 acts as a cam in the right hand slot 104, but the rivet 134 only connects the slider 90 to the upper base leg 50. In the alternative, bolts or other types of shafts may be used in place of the rivets.

The upper assembly 44, FIG. 5, includes eight upper arms 140, 142, 144, 146, 148, 150, 152, 154, four corner assemblies 160, 162, 164, 166 and four medial latch connectors 170, 172, 174, 176. As was earlier done, only a portion of the frame will be detailed because all other like structures of the frame are identically configured. The upper arm 140 is pivotally connected to the corner assembly 160 by a rivet 180 and to the latch connector 170 by a rivet 182. The upper arm 144 that is positioned perpendicular to the upper arm 140 is pivotally connected to the corner assembly 162 by a rivet 184 and to the latch connector 172 by a rivet 186. The remaining upper arms are arranged in similar fashion. Each corner assembly may be configured with two adjoining pairs of corner plates at a right angle to each other, such as the corner assembly 160 having a pair of corner plates 190, 192 at right angles to the pair of corner plates 194, 196. Each lower corner assembly may also be formed by a pair of plates, such as the lower corner assembly 72 being formed of the pair of plates 198, 200.

Figure 7:
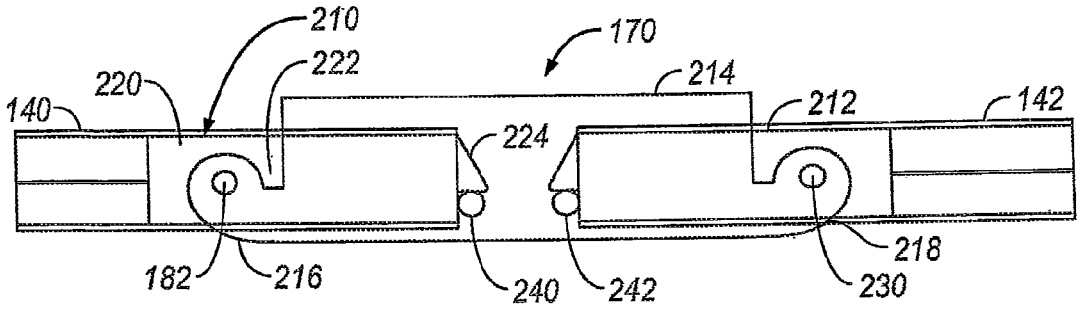
FIG. 7 is an enlarged elevation view of a latch connector of the frame shown in FIG. 5.

Each latch connector, such as the latch connector 170, FIG. 5, shown enlarged in FIG. 7, includes first and second, oppositely disposed, spring loaded slide bolts 210, 212, and a generally U-shaped cover 214 with extending side ears 216, 218. Each slide bolt, such as the slide bolt 210, includes a sleeve 220, and in the sleeve, a spring 222, and a slideable, spring biased nosepiece 224. A first rivet, such as the rivet 182, pivotally connects the left slide bolt 210 and the side ear 216 of the cover 214 to the upper arm 140, and another rivet 230 pivotally connects the right slide bolt 212 to the side ear 218 of the cover to the upper arm 142, and each of the rivets 182, 230 also retains the bolt springs, such as the spring 222. Two additional rivets 240, 242 are fixed to the cover 214 to engage the nosepieces, such as the nosepiece 224, when the upper arms are locked in their horizontal positions as shown. Each slide bolt is connected to a cable as will be described below.

The side structure 46 includes four generally vertically disposed side posts 250, 252, 254, 256, FIG. 5. Each side post is pivotally connected to a respective lower corner assembly by a rivet and to an upper corner assembly by two rivets, such as the post 250 being pivotally connected to the lower corner assembly 70 by a rivet 260, and being fixed to the upper corner assembly 160 by the two rivets 262, 264. This arrangement permits the side posts to pivot or tilt outwardly and, at the same time, pull the upper corner assemblies outwardly or apart from one another. Each side post also encloses an operative structure that may take the form of a set of cables as more clearly shown in FIGS. 8 and 9. Accordingly the operative structure is in mechanical communication with the upper arms of the upper assembly, and the base assembly to move the upper arms and the latch connectors to positions consistent with an opened enclosure and positions consistent with a folded enclosure in response to movement of the base assembly. A first cable of each set of cables is connected to one of the right hand set of holes in a cam-follower slider mounted in each upper base leg near the lower corner assembly to which the upper base leg is pivotally connected. The cable then extends upward through the side post pivotally connected to the same lower corner assembly, and then the cable divides into two strands to connect to the ends of two adjacent upper arms that are pivotally connected to the upper corner assembly to which the side post is connected. For example, the cable 270 is connected at one end to the slider 90 and at the other two ends 270*a* and 270*b* to the adjacent upper arms 140 and 154. A second cable of each set of cables is connected to one of the left hand set of holes in the cam-follower slider, and the cable then extends upward through the side post before also dividing into two strands to connect to the two slide bolt nosepieces located in the adjacent upper arms. For example, the cable 272 is connected at one end to the slider 90 and at the other two ends 272*a* and 272*b* to the slide bolts of the latch connectors 170 and 176 mounted to the adjacent upper arms 140 and 154.

The base legs, upper arms and side posts may be formed of any suitable tubes, rails, bars, beams, shafts, spars, rods or the like. Where applicable, any suitable cross sectional configurations may be used, such as tubular, square, rectangular, I-beam, L-shaped, H-shaped and C-shaped. An extrusion of sufficient strength and stiffness should suffice and the material may be plastic or metal or any other suitable material. The upper and lower corner assembly plates may also be formed of plastic or metal or any other suitable material.

Figure 10:
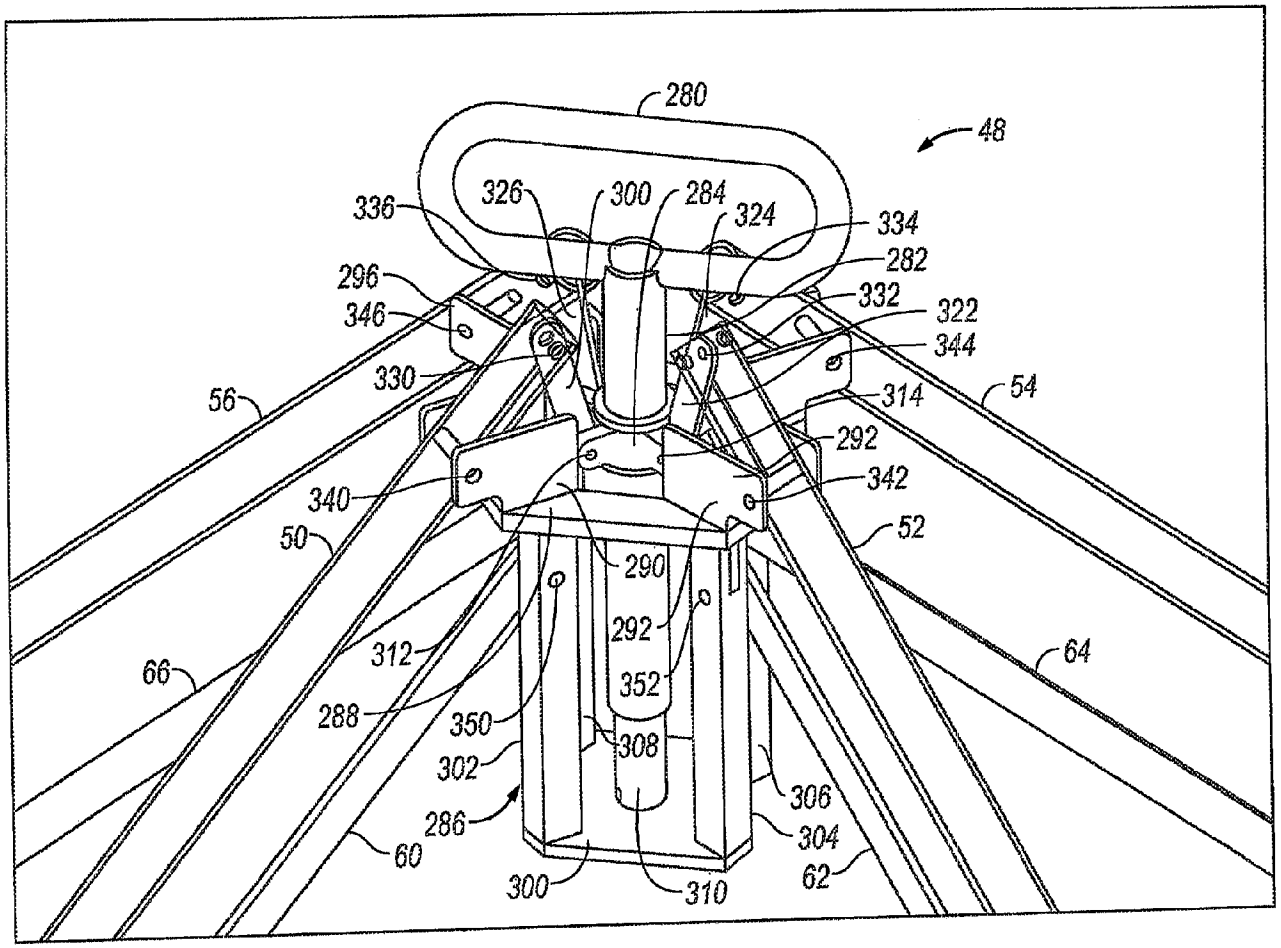
FIG. 10 is an enlarged downward looking isometric view of a hub assembly of the frame shown in FIG. 19.
Figure 11:
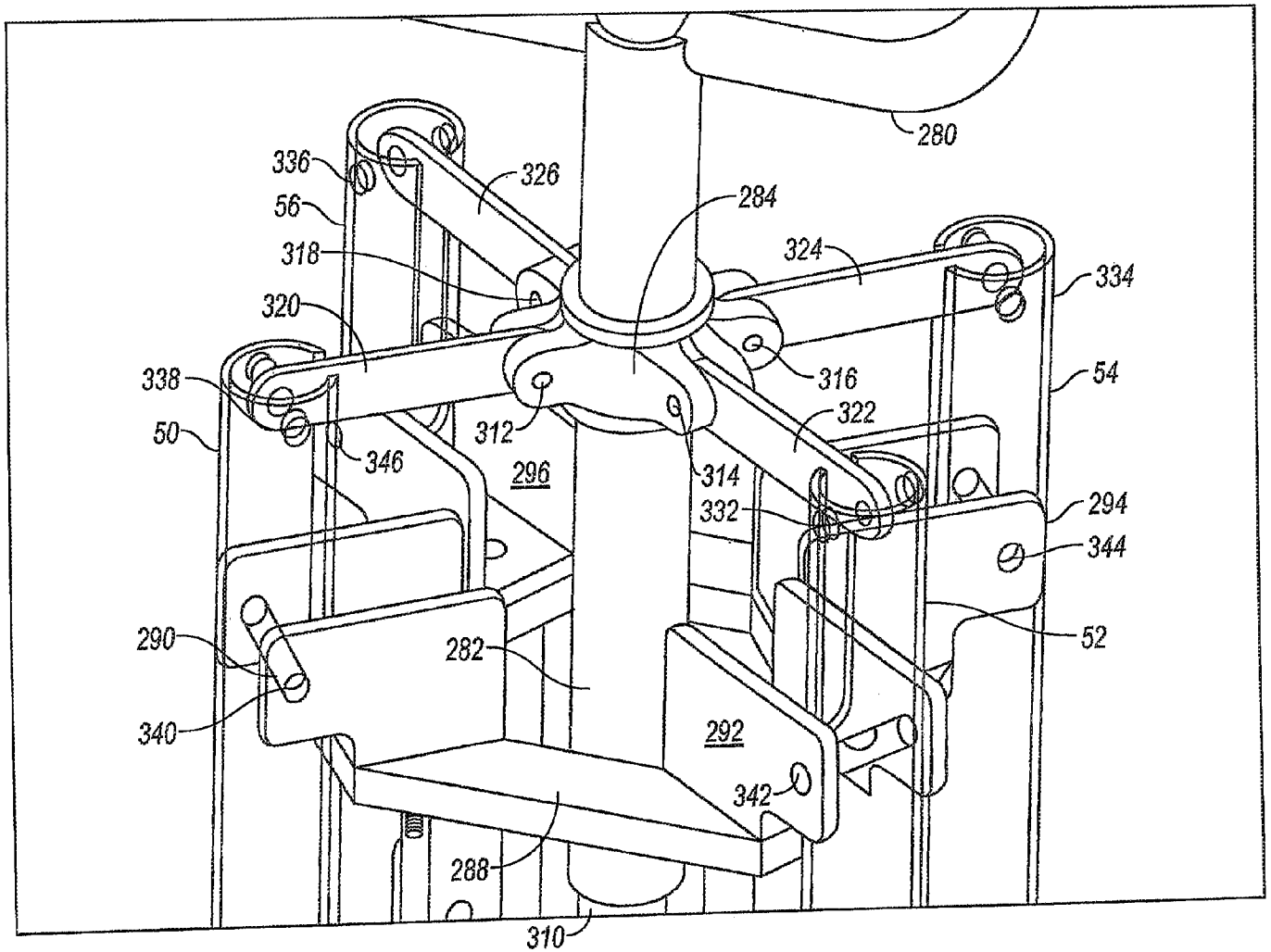
FIG. 11 is an enlarged downward looking isometric view of the hub assembly of the frame in FIG. 12.

The hub assembly 48, FIG. 10, includes a handle 280, a sleeve 282 connected to the handle, a collar 284 connected to the sleeve, and a mounting structure 286, where the mounting structure includes an upper ring support 288, four brackets 290, 292, 294, 296 mounted to the upper ring support, a lower support plate 300, four vertical beams 302, 304, 306, 308 connecting the upper ring support and the lower support plate, and an upstanding shaft 310. Pivotally connected to the collar 284 by four rivets 312, 314, 316, 318, FIG. 11, are four links 320, 322, 324, 326. The four links are pivotally connected at their opposite ends by four rivets 330, 332, 334, 336 to the four upper base legs 50, 52, 54, 56. The four upper base legs are further pivotally connected to the four brackets 290, 292, 294, 296 by four rivets 340, 342, 344, 346. The four corresponding lower base legs 60, 62, 64, 66 are pivotally connected to the four beams 302, 304, 306, 308 by four rivets 350, 352, 354, 356. The sleeve 282 is configured to move vertically over the shaft 310, and the handle 280 may be pivotally mounted to the sleeve so as to be rotated downwardly about 90.degree. when not in use.

When a user wishes to take the folded enclosure and cause it to deploy, the user simply pushes the handle downwardly. As shown in FIG. 11, the links 320, 322, 324, 326 are generally positioned in a horizontal attitude and offer great leverage when pushing the handle 280 and the sleeve 282 downward. The leverage achieved is a major advantage of the present invention. At one end, each link pivots easily relative to the collar, and at the other end, a strong moment arm is created to easily pivot each upper base leg. The lower base legs follow by pivoting relative to the vertical beams of the hub assembly. The base legs also pivot relative to the lower corner assemblies and cause the cables to selectively pull on the upper arms to cause their rotation. The cables also selectively pull on the slide bolt nosepieces of the latch connectors.

Figure 12:
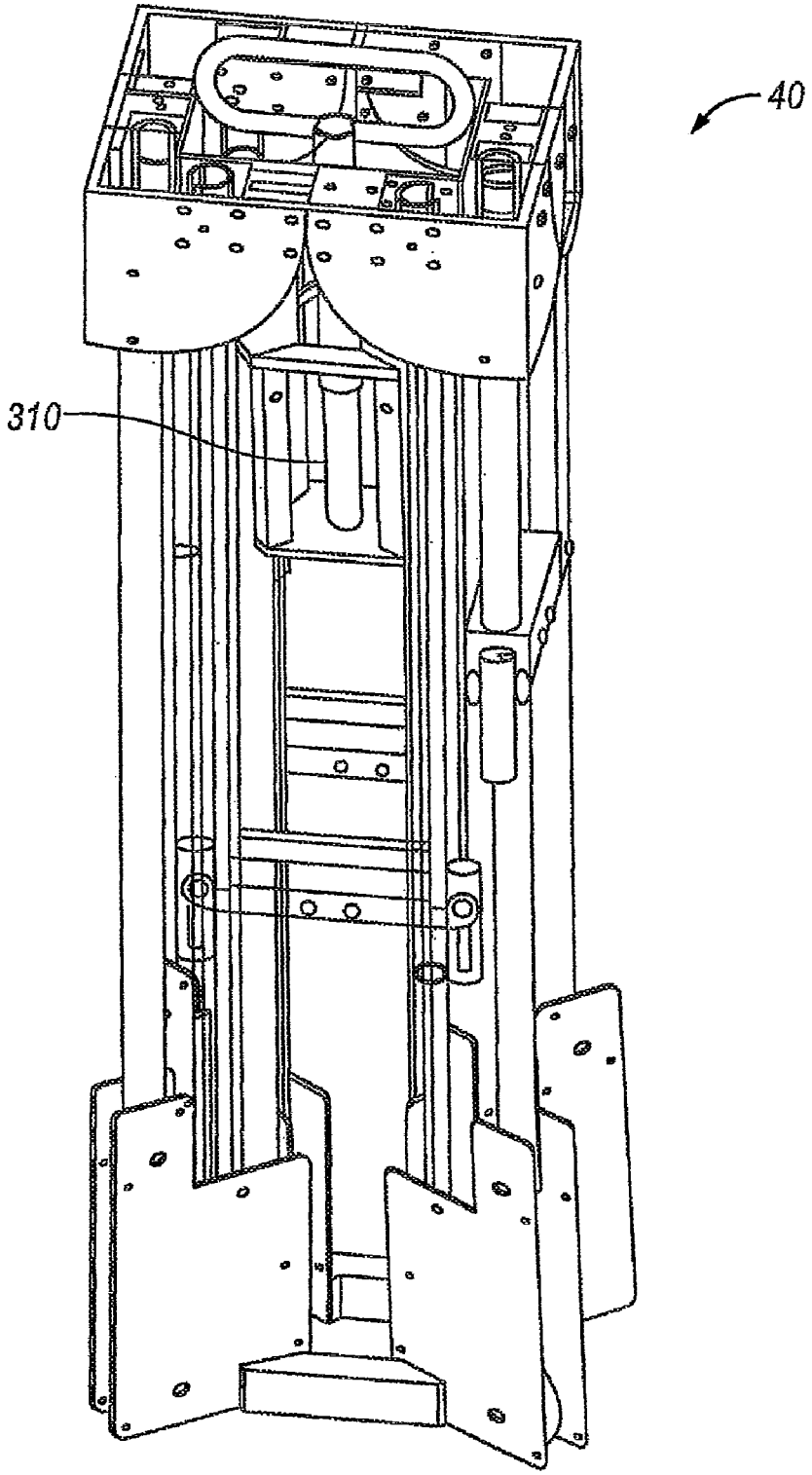
FIG. 12 is an enlarged isometric view of the folded frame shown in FIG. 4.
Figure 13:
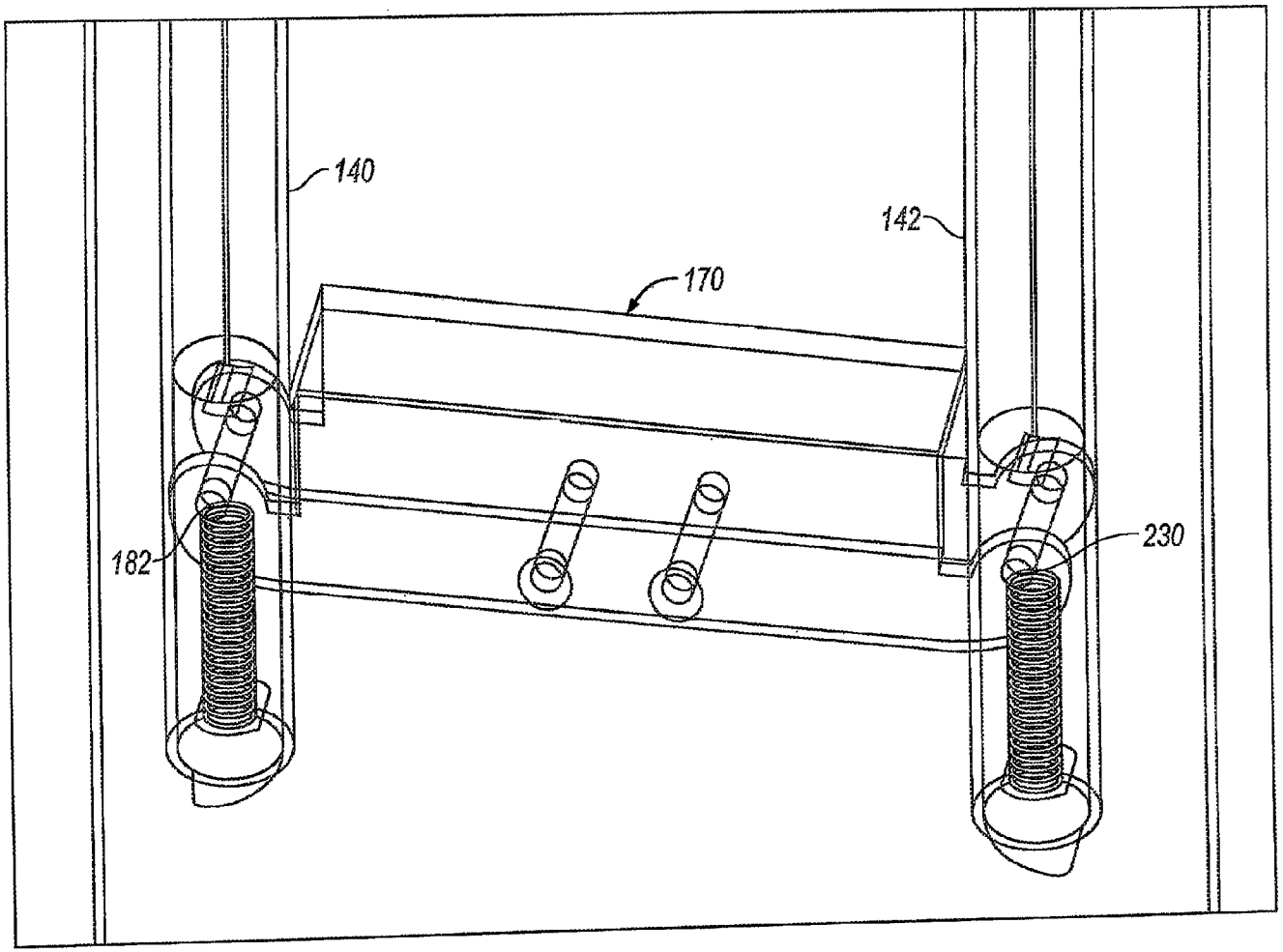
FIG. 13 is an enlarged isometric view of the latch connector shown in FIG. 12.
Figure 14:
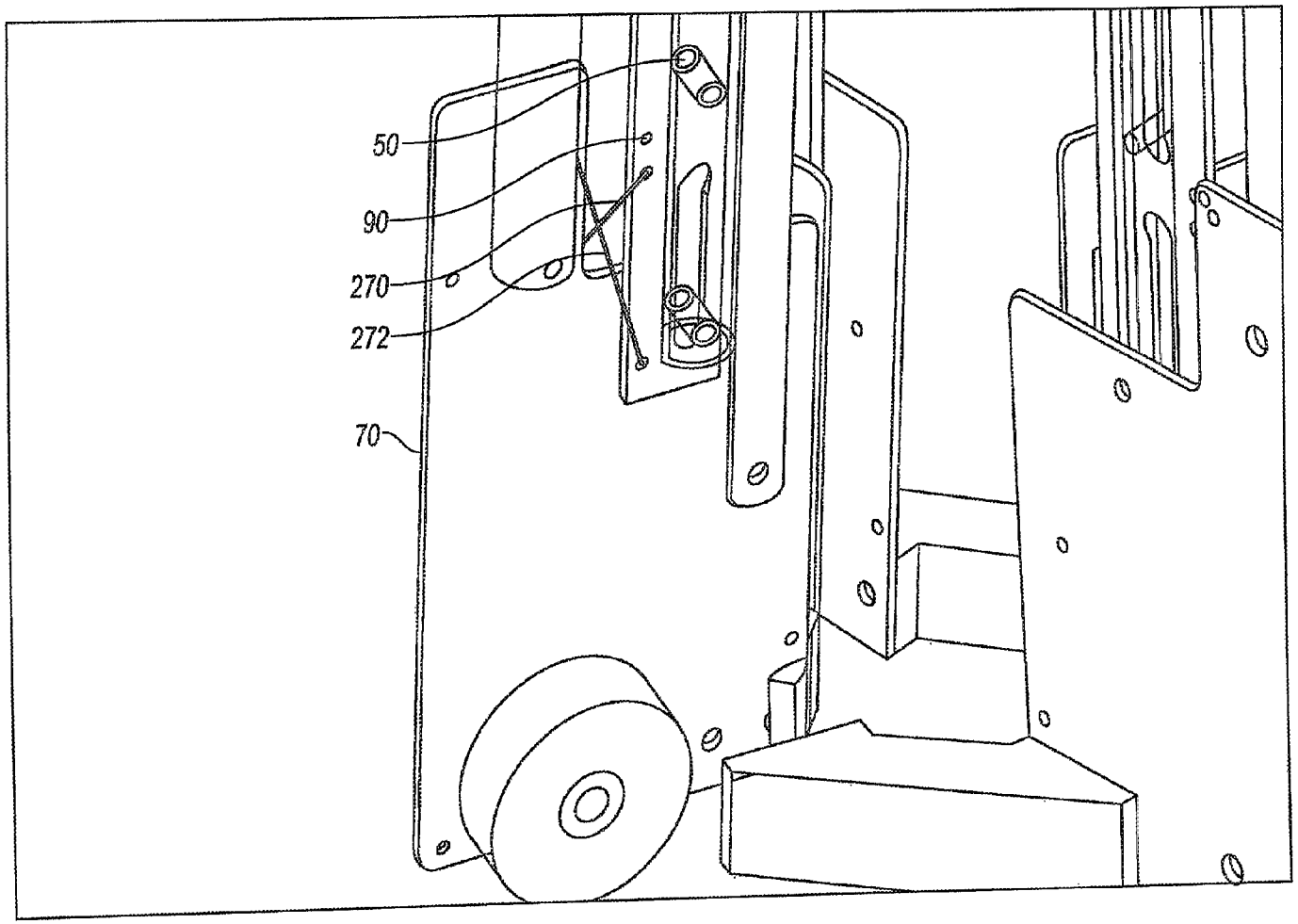
FIG. 14 is an enlarged isometric view of the partial lower corner assembly shown in FIG. 12.
Figure 15:
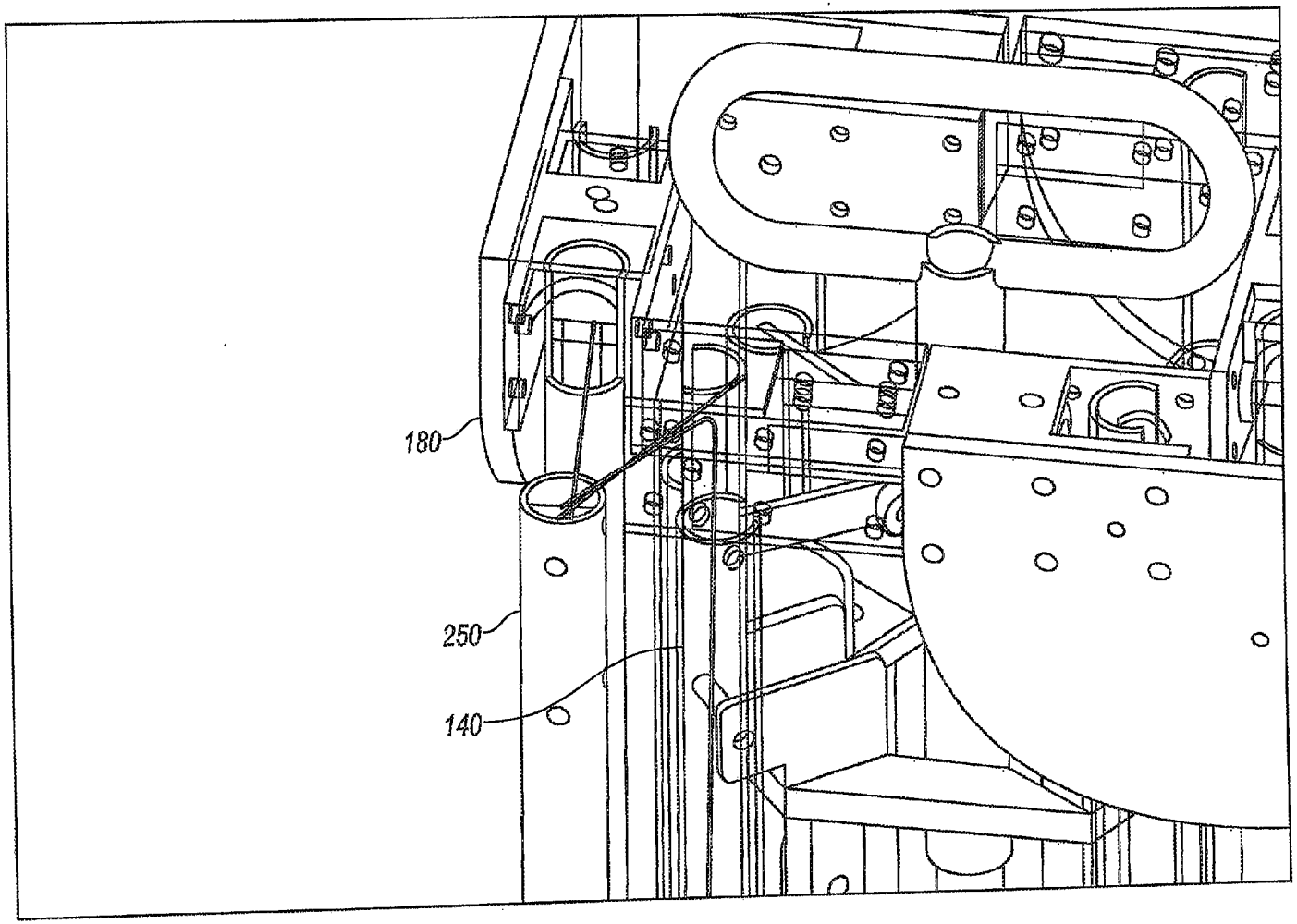
FIG. 15 is an enlarged isometric view of the partial upper corner assembly shown in FIG. 12.

Operation of the frame 40 is described in reference to FIGS. 5, 8-26. Six positions of the frame will be illustrated, analyzed and described in detail, in sequence from folded to open, and back to folded. This is done by a study of the positions of the hub assembly, the latch connector, the base assembly, and the upper assembly, in each of the six positions of the frame. Referring first to FIG. 12, the frame 40 is in a folded position. The hub assembly, as shown in FIG. 11, is at the top of its cycle about twenty inches above a floor upon which the frame rests. The base legs are rotated upwardly to generally vertical positions and all of the upper arms are rotated downwardly to the same generally vertical positions. Most of the shaft 310 of the hub assembly is exposed and the hub links are positioned generally horizontally to give excellent leverage for opening the frame. The latch connectors are disengaged such that the upper arms point downwardly as shown in FIG. 13. The base legs are positioned upwardly and the slider 90 is positioned mostly in the upper base leg 50. The slider is restrained in the upper base leg by the rivet 134 in the recess formed by the lower edge 132 in the left end of the right slot 104. The upper arms are hanging from rivets, such as the rivet 180, as shown in FIG. 15, where the corner assembly plate is removed for clarity, and the cables are in little or no tension. In the folded position, the frame and thereby the play yard enclosure, are compactly arranged and are stable and may be covered or packaged so that the enclosure may be easily carried and/or stored.

Figure 8:
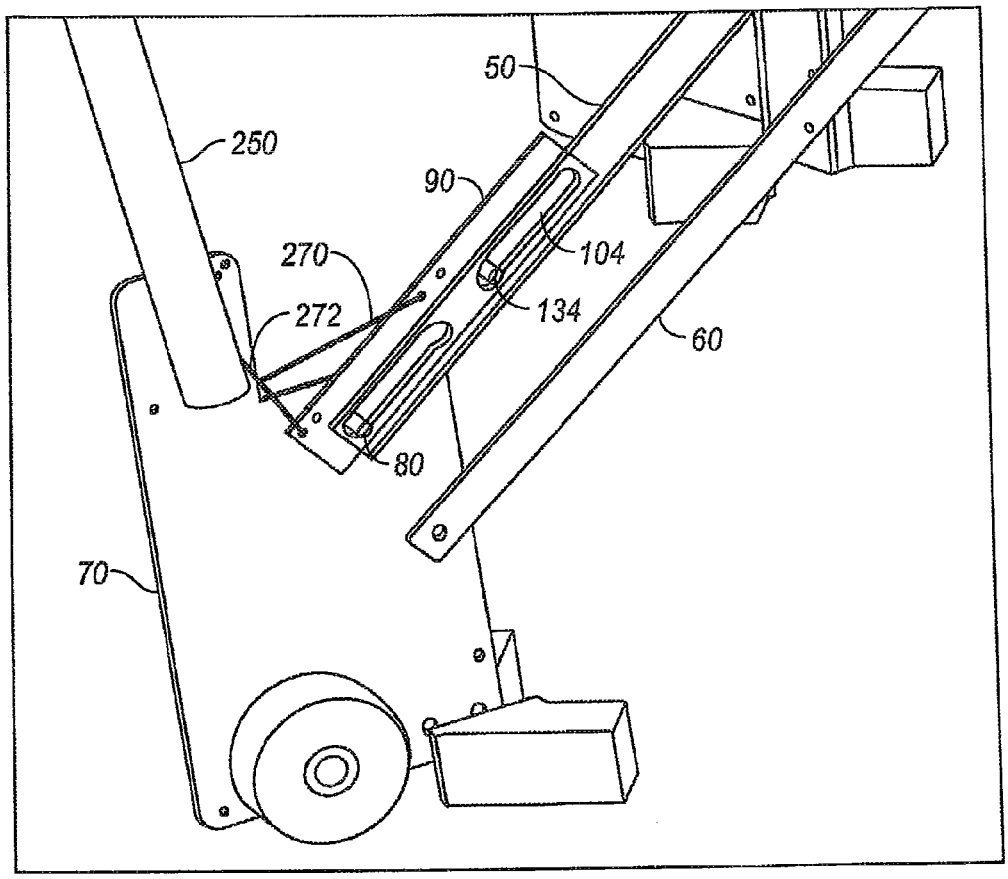
FIG. 8 is an enlarged isometric view of a partial lower corner assembly of the frame shown in FIG. 16.
Figure 9:
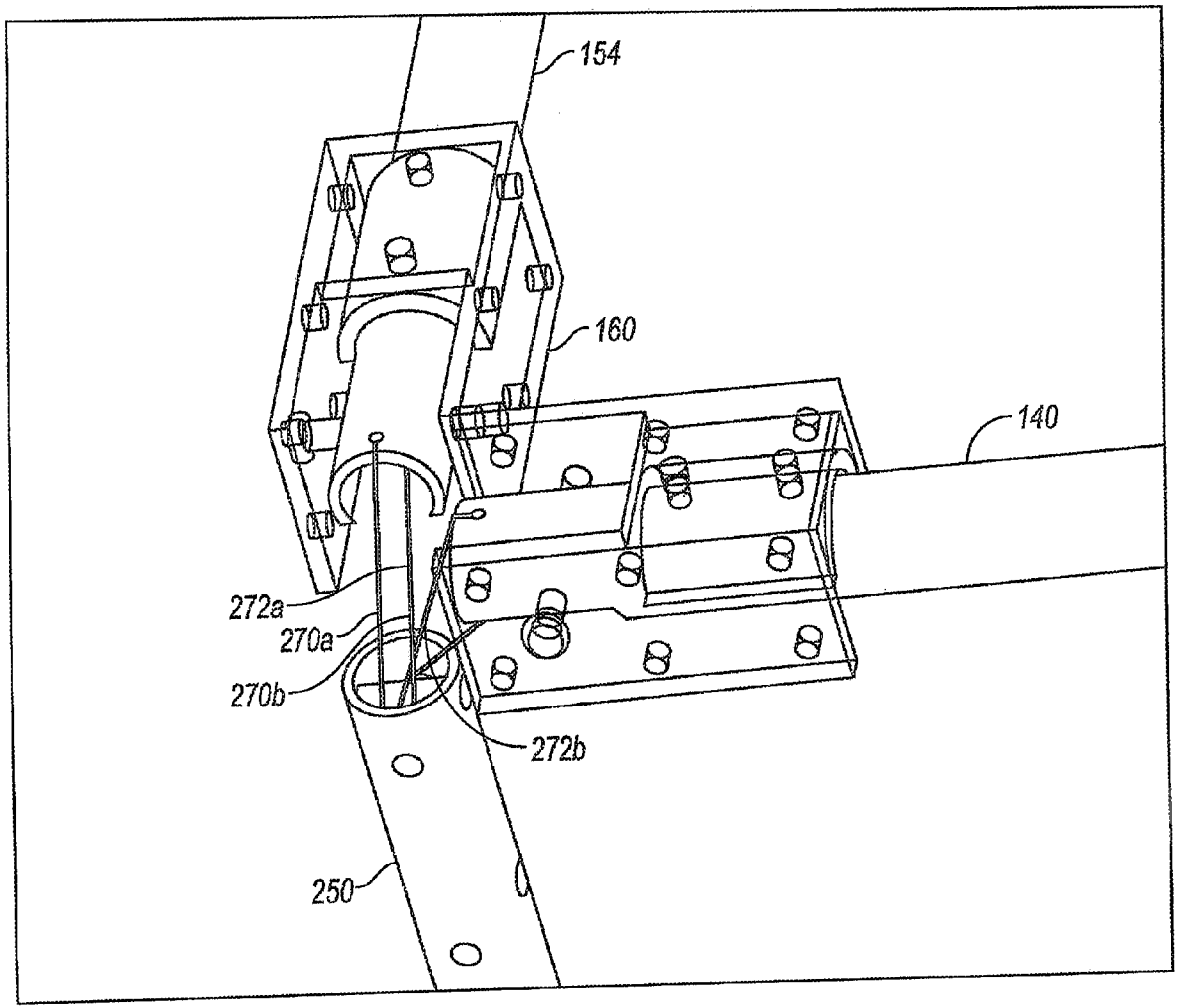
FIG. 9 is an enlarged downward looking isometric view of a partial upper corner assembly of the frame shown in FIG. 16.
Figure 16:
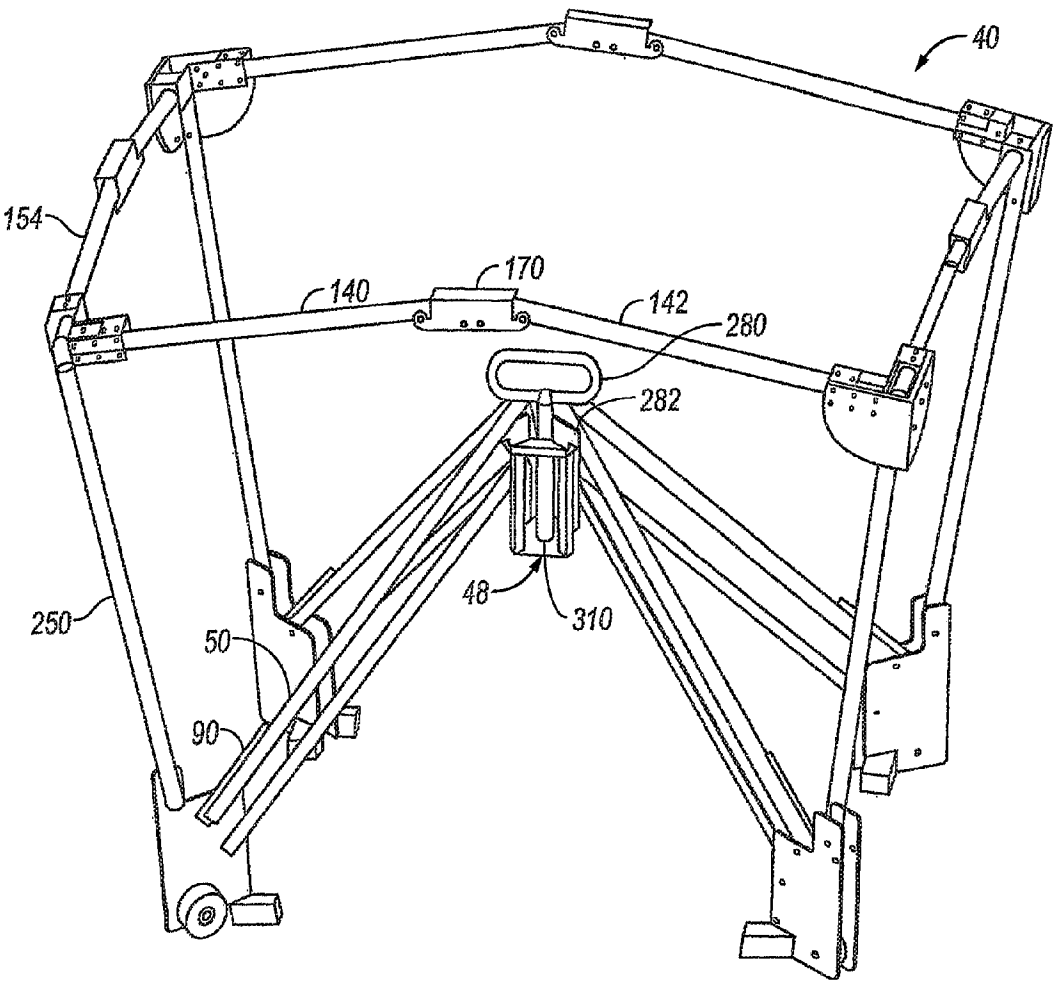
FIG. 16 is an isometric view of the frame as it moves toward an opened position.
Figure 17:
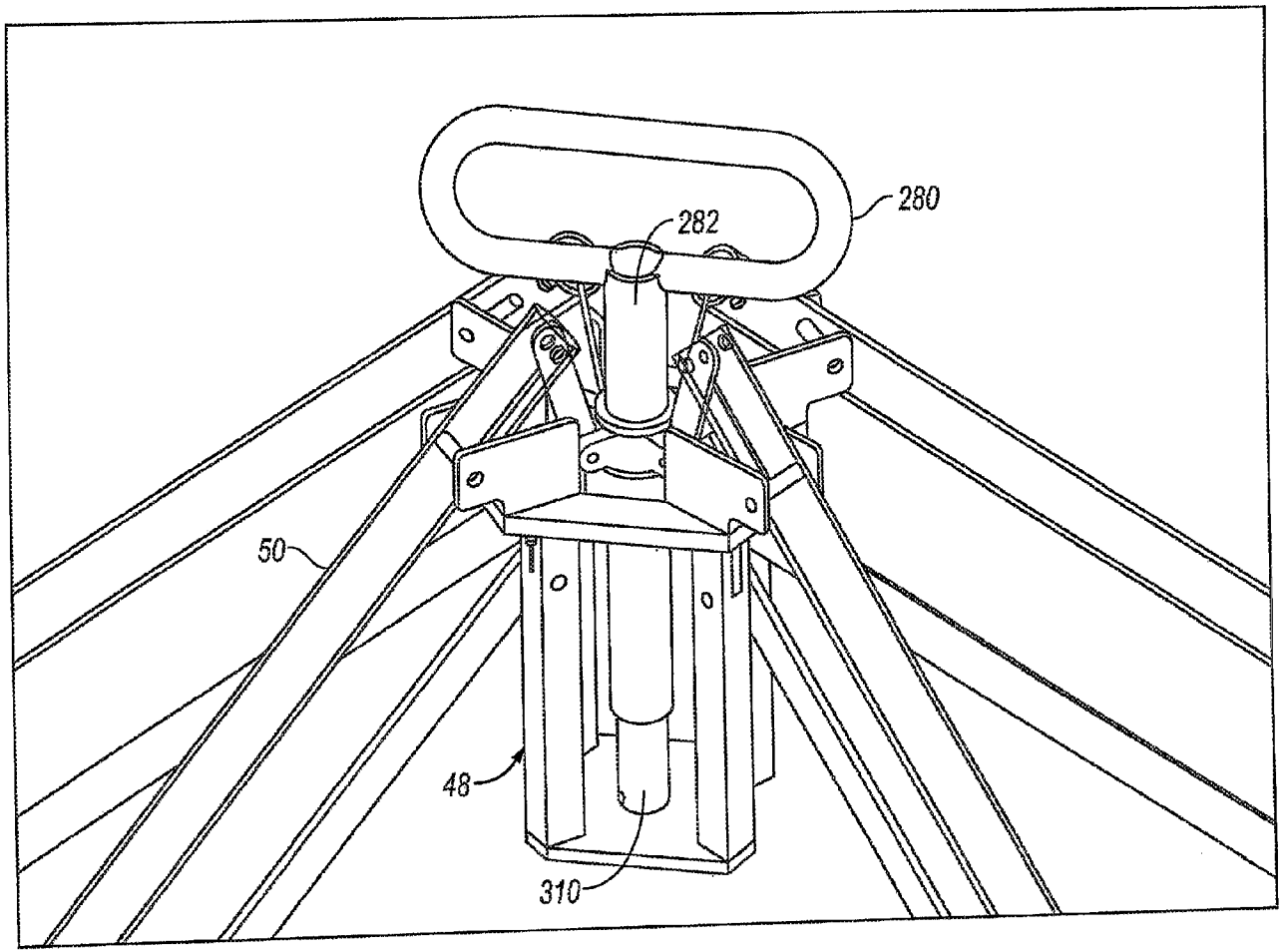
FIG. 17 is an enlarged isometric view of the hub assembly shown in FIG. 16.
Figure 18:
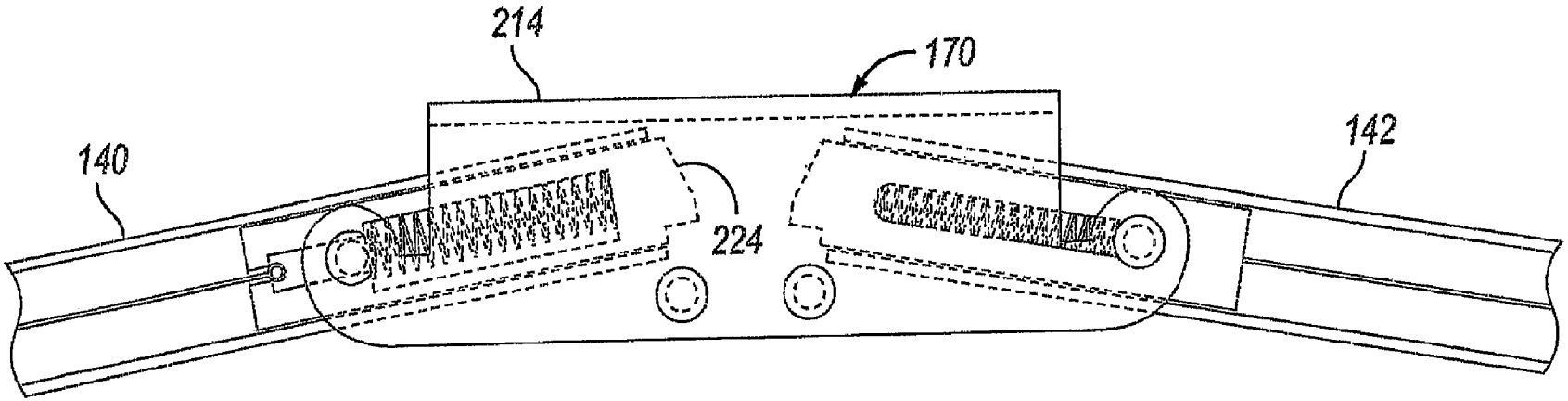
FIG. 18 is an enlarged elevation view of the latch connector shown in FIG. 16.

Referring now to FIG. 16, the frame 40 is shown in a partially opened position when the hub assembly 48 is about fourteen inches above the floor. The base legs are rotated about 45.degree. from a vertical reference line, but the upper arms are positioned a few degrees above horizontal. The handle 280 and the sleeve 282 of the hub assembly, as shown in FIG. 17, is lowered on the shaft 310 and the hub links have rotated the base legs downwardly. As shown in FIG. 18, the upper arms 140, 142 are slanted upward within the cover 214 of the latch connector 170 and the nosepieces of the slide bolts, such as the nosepiece 224, are extended. Referring to FIGS. 8 and 9, the partially lowered base legs and the restrained slider 90 allow the cable 270 to be tensioned so that the upper arms 140 and 154 are raised. The downward rotation of the base legs helps the upper arms to rotate upwardly. The side posts, such as the side post 250, tilt outwardly and the frame is still relatively stable. It is to be noted that the outward tilt of the side posts allows the latch connectors to lock when the upper arms go to a position higher than horizontal, well past the positions where the nosepieces snap into place, thereby providing for reliable locking of the latch connectors.

Figure 19:
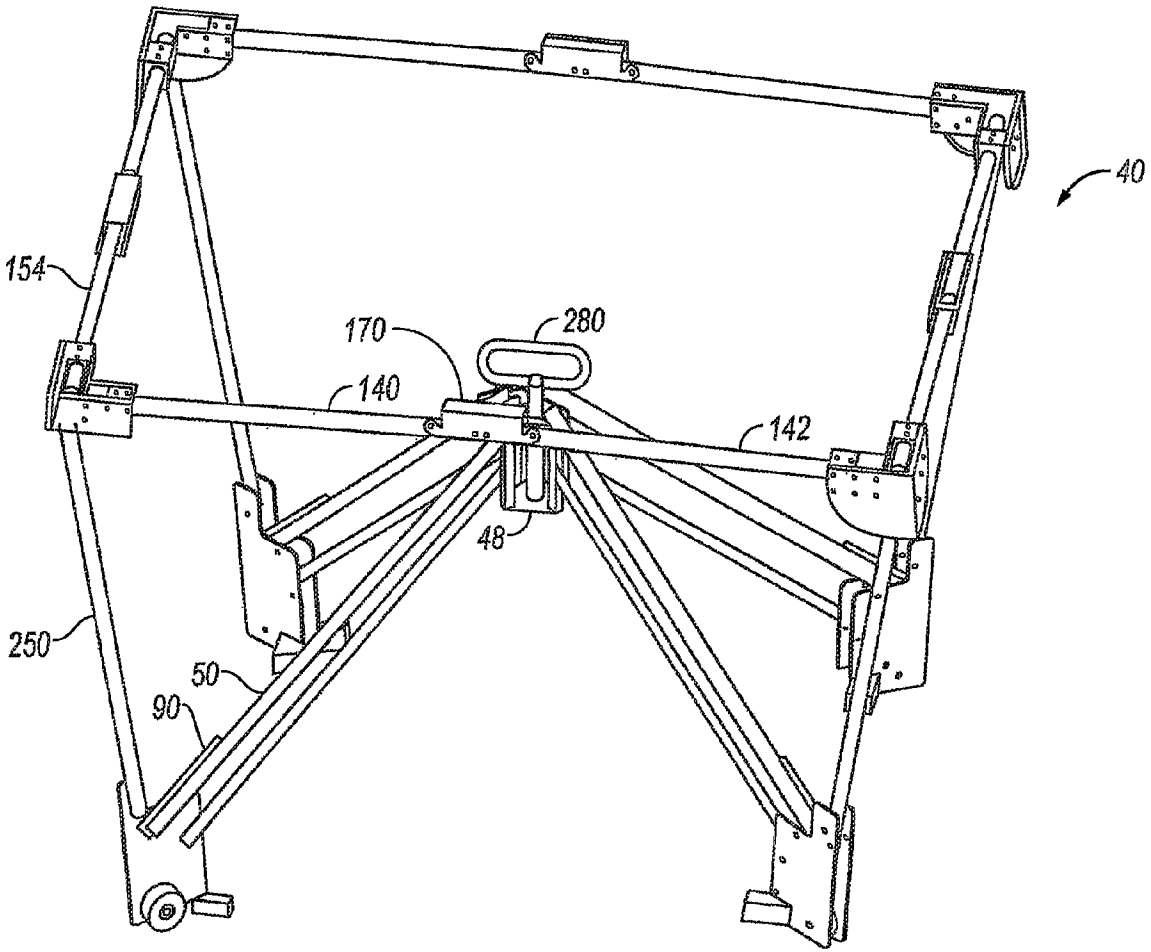
FIG. 19 is an isometric view of the frame as it moves further to the opened position.
Figure 20:
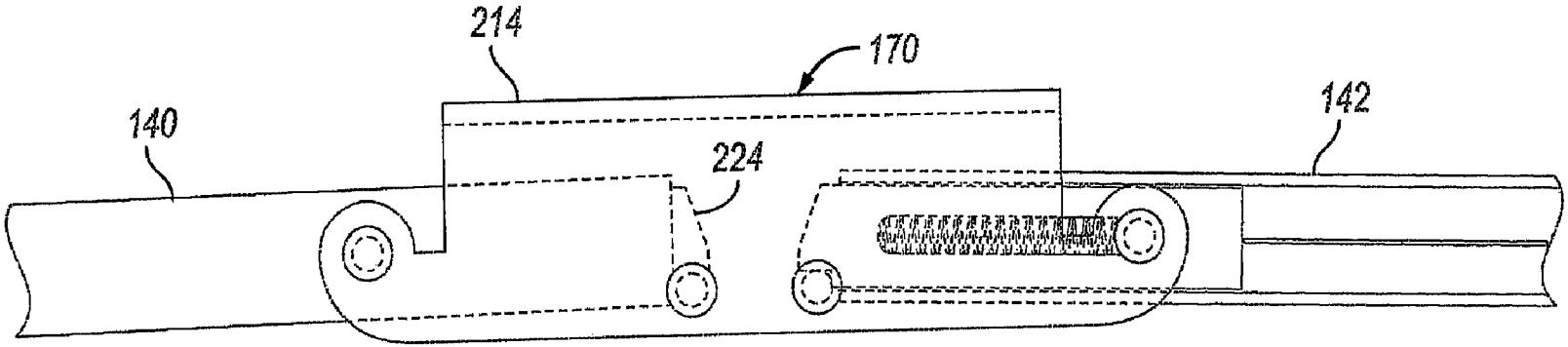
FIG. 20 is an enlarged elevation view of the latch connector shown in FIG. 19.
Figure 21:
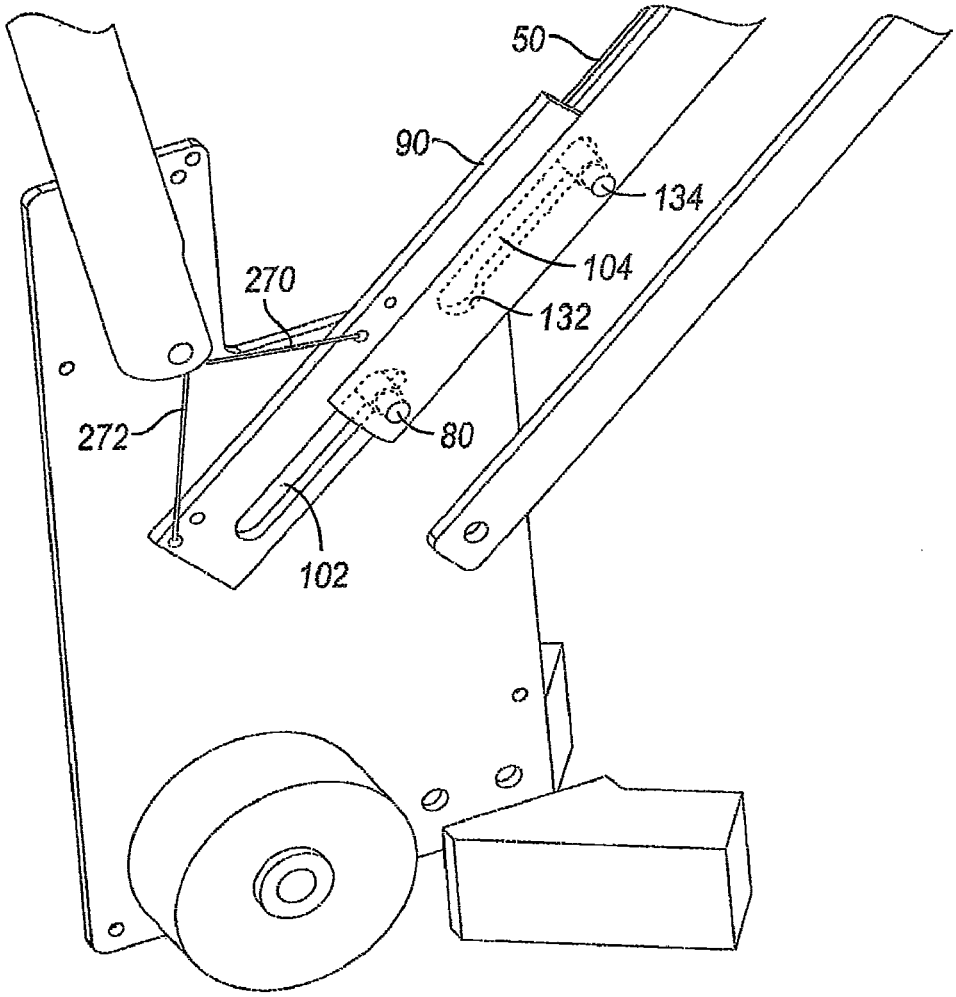
FIG. 21 is an enlarged isometric view of the partial lower corner assembly shown in FIG. 19.
Figure 22:
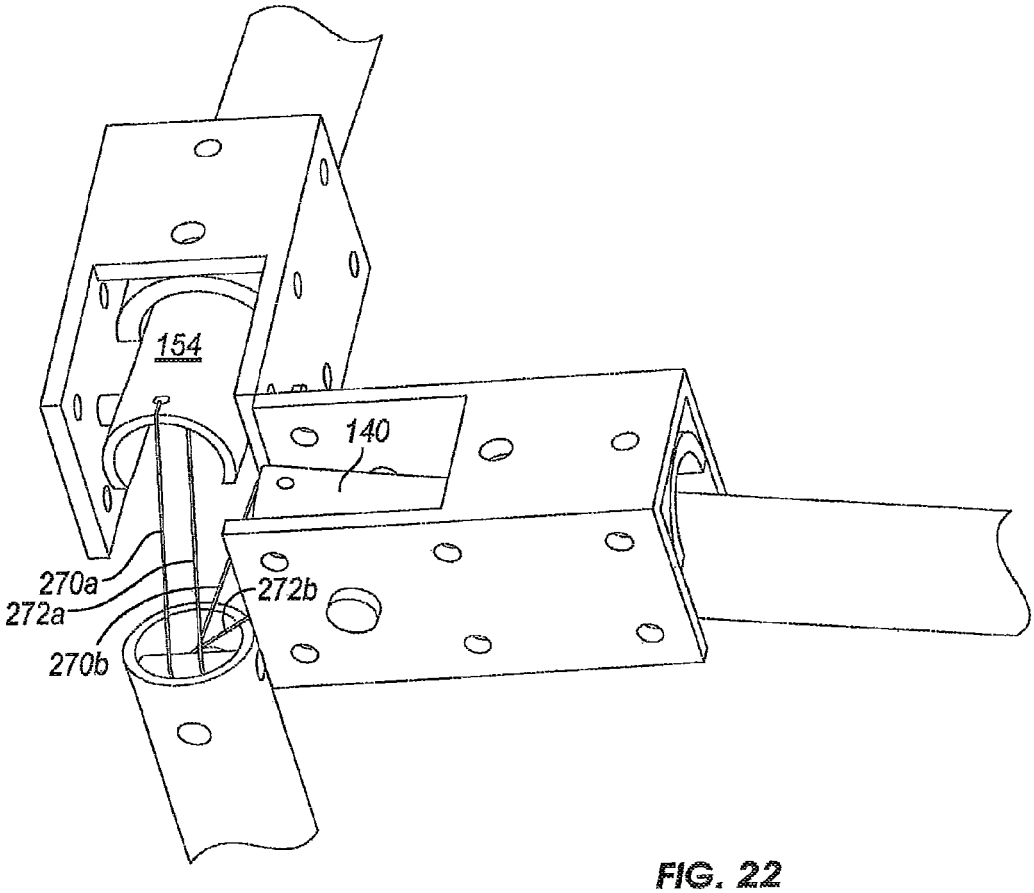
FIG. 22 is an enlarged isometric view of the partial upper corner assembly shown in FIG. 19.

In the next step of the sequence, reference is made to FIG. 19, which illustrates the frame further along toward full deployment. The upper arms are returned to generally horizontal positions, the side posts are still pivoted outwardly, and the hub assembly is about ten inches above the floor. The base legs are rotated several more degrees downwardly and, as shown in FIG. 10, the hub sleeve is covering more of the hub shaft. The cover 214 of the latch connector is about parallel with the upper arms 140, 142 as shown in FIG. 20. The force exerted by the cable 270 has now rotated close enough to be parallel to the slider cam slot to release rivet 134 from the properly angled pocket 132. Once the slider moves, it slides quickly or "pops" in a leftward direction to the position shown in FIG. 21, where the rivets 80 and 134 abut the right ends of the slots 102, 104. This movement removes the tension in the cable 270 to enable the upper arms to be lowered to horizontal positions shown in FIG. 22. As the hub assembly is lowered toward the floor to the fully open the frame, the frame is forced into an over tensioned condition. This condition provides desirable stiffness to the entire frame.

Figure 23:
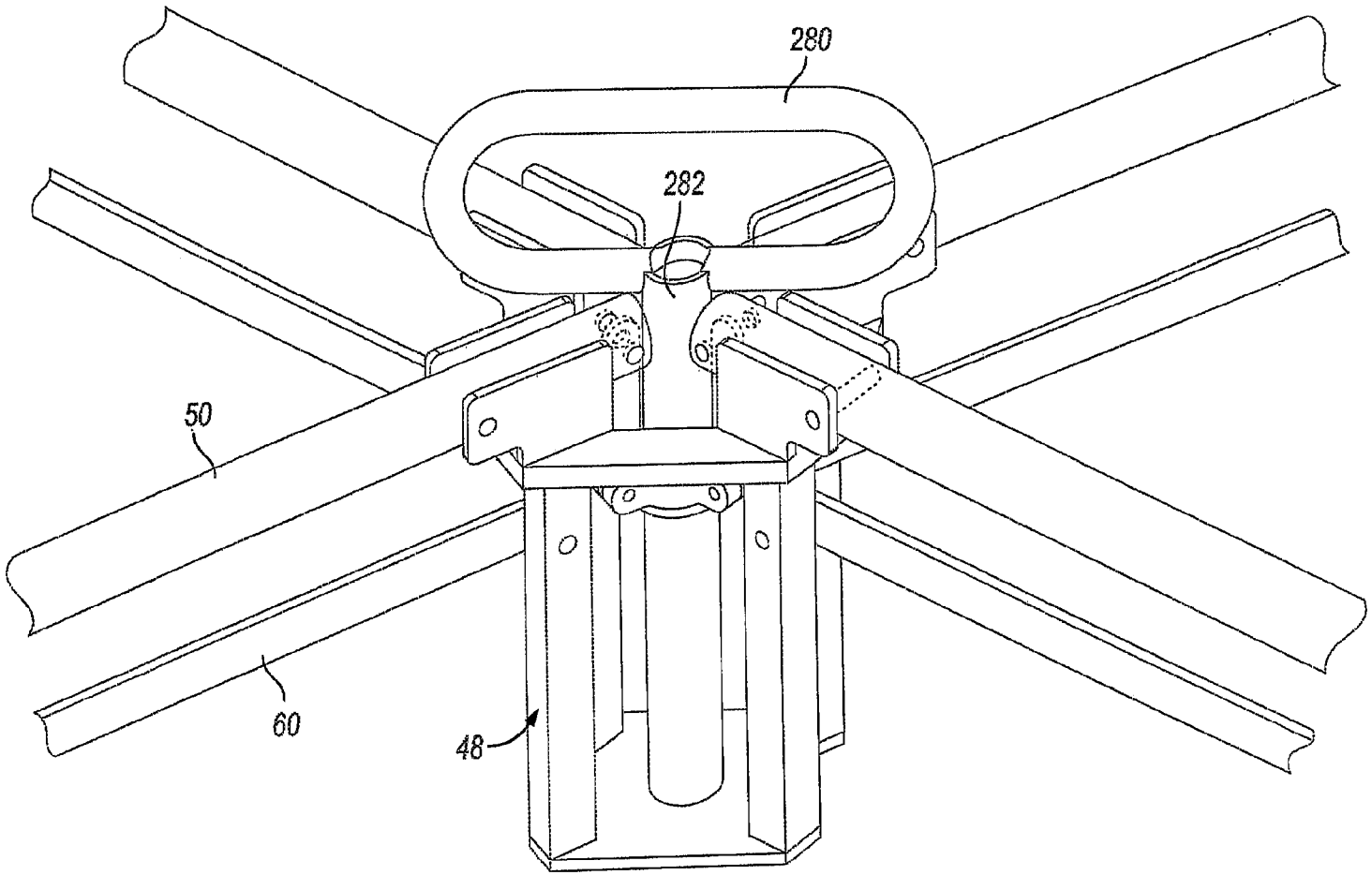
FIG. 23 is an enlarged isometric view of the hub assembly shown in FIG. 5.
Figure 24:
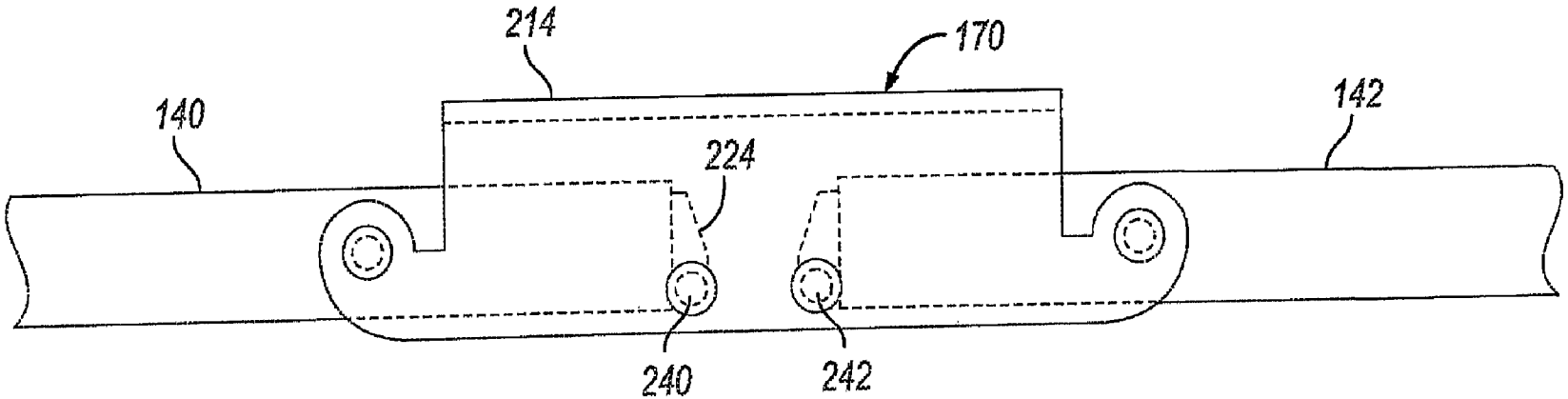
FIG. 24 is an enlarged elevation view of the latch connector shown in FIG. 5.
Figure 25:
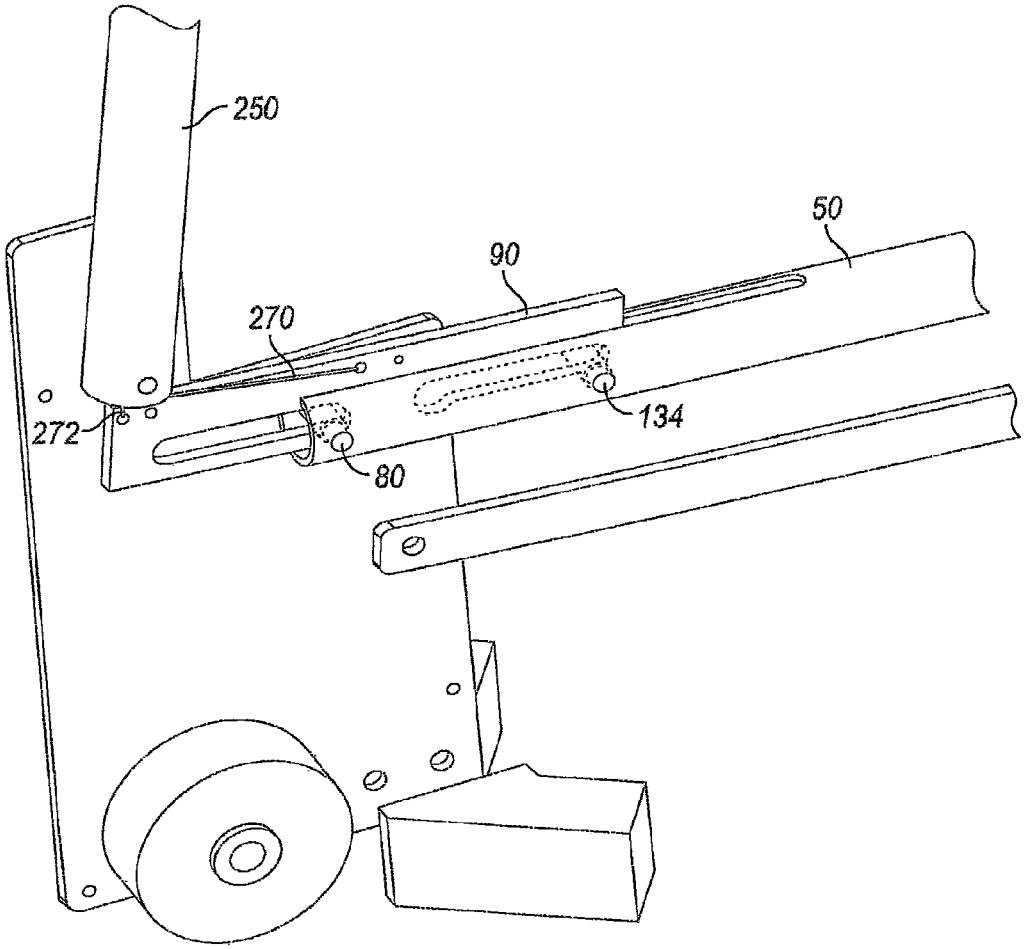
FIG. 25 is an enlarged isometric view of the partial lower corner assembly shown in FIG. 5.
Figure 26:
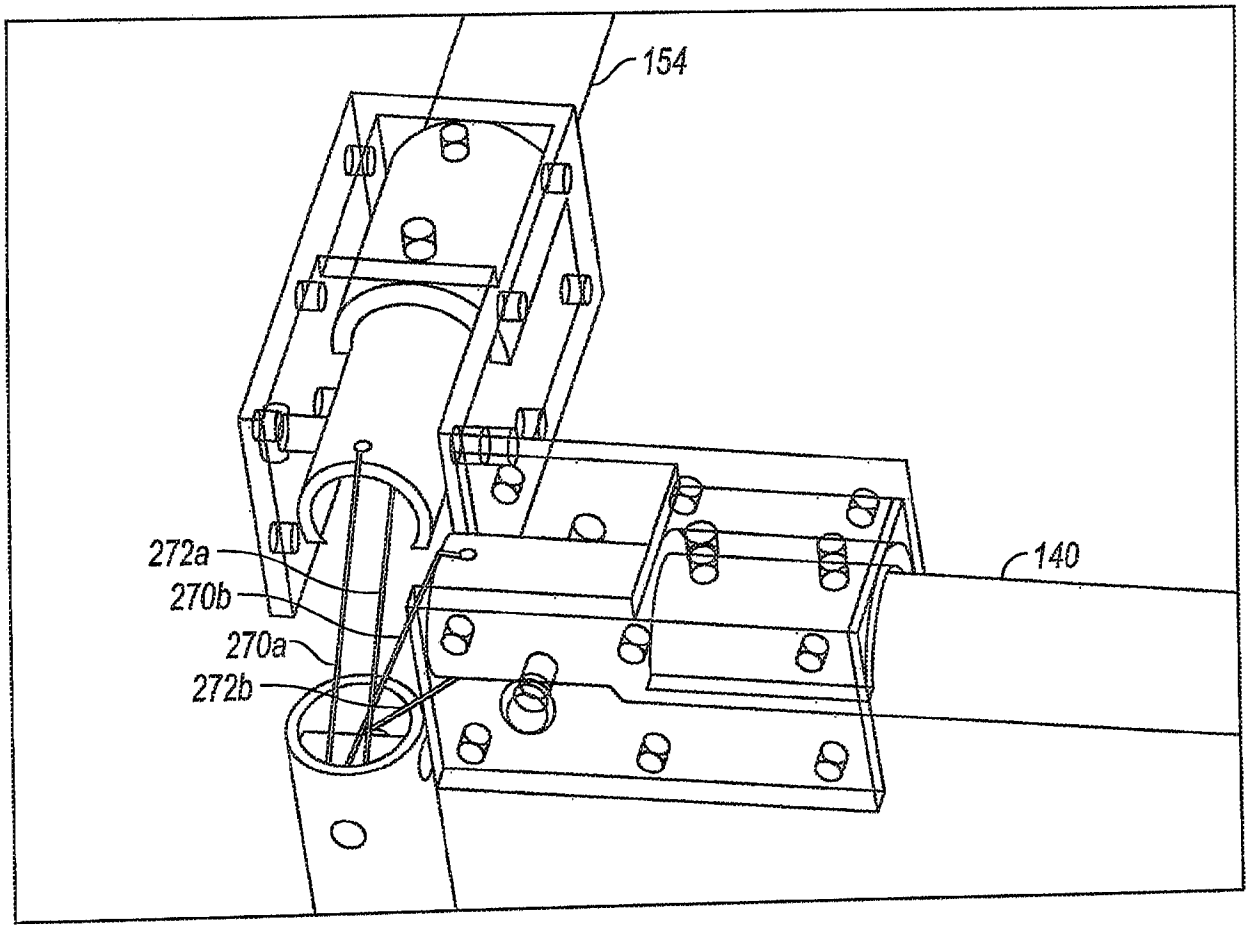
FIG. 26 is an enlarged isometric view of the partial upper corner assembly shown in FIG. 5.
Figure 27:
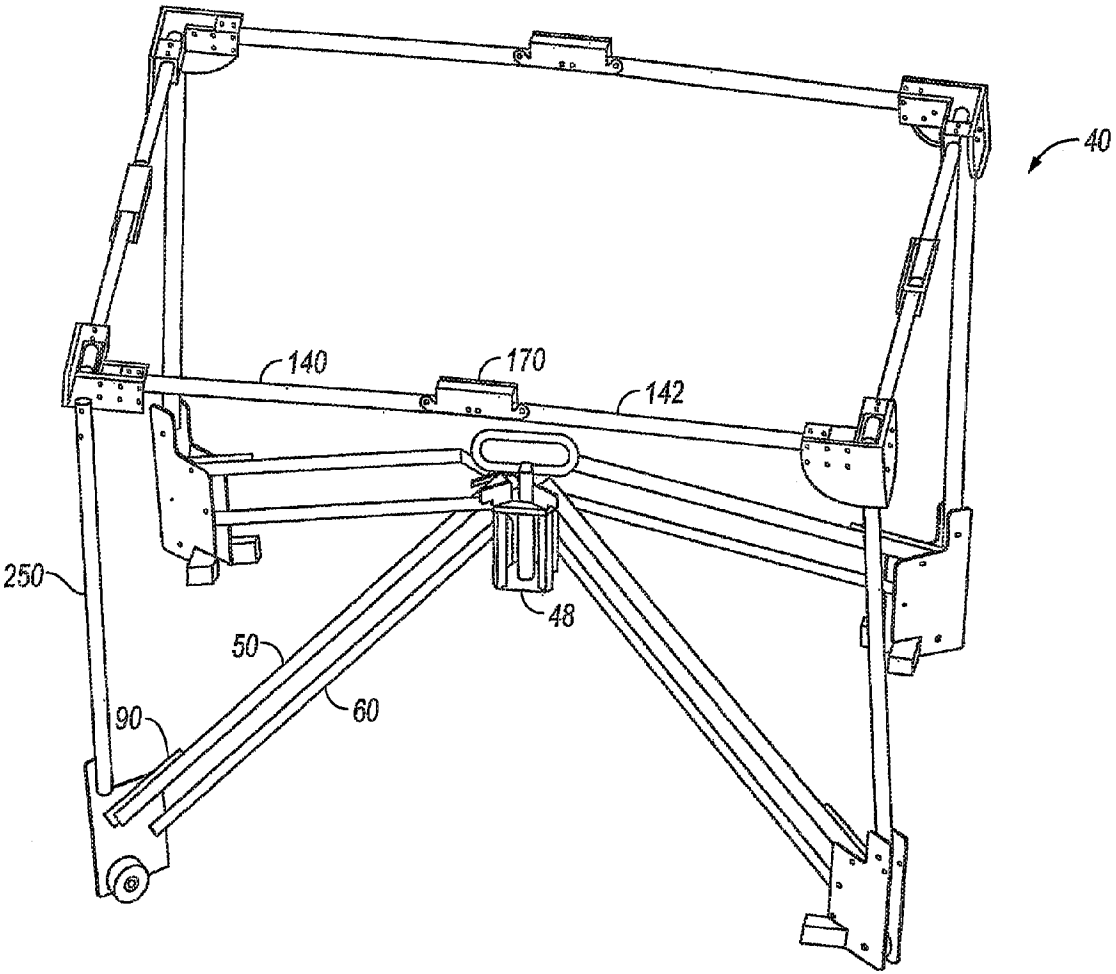
FIG. 27 is an isometric view of the frame as it moves to the folded position.

In the fourth step of the opening sequence, as shown in FIG. 5, the frame is illustrated in the full opened position. The hub assembly is on the floor or nearly so, the hub sleeve has covered about all of the shaft as shown in FIG. 23, and all of the base legs and upper arms are generally in horizontal positions. The slide bolt nosepieces in the upper arms are released and abut the rivets 240, 242 of the latch connector as shown in FIG. 24, so that the upper arms are locked in place. The frame is very stable with the side posts leaning slightly inward. Referring to FIGS. 25 and 26, the slider is still extended, and the upper base leg has rotated down to a horizontal position. Because of the positions of the slider and the base leg the cables are loose or slack. This looseness is critical as it provides a "visually obvious" indication for the user should the latches fail to engage properly because the upper rails will droop noticeably. The slider is now restrained by the rivet 80 located in the recess formed by the lower edge 116 in the right end of the left hand slot 102. In progressing from the fully folded position to the fully opened position the frame may be viewed as going through three phases. Initially, there is a "spreading phase," followed by a "lift and lock phase" and then the last phase, "tensioning." It is important to separate the lift and lock phase from the tensioning phase because tensioning the frame during lift and lock could cause the locks to not latch properly and this would cause an unsafe condition.

Figure 28:
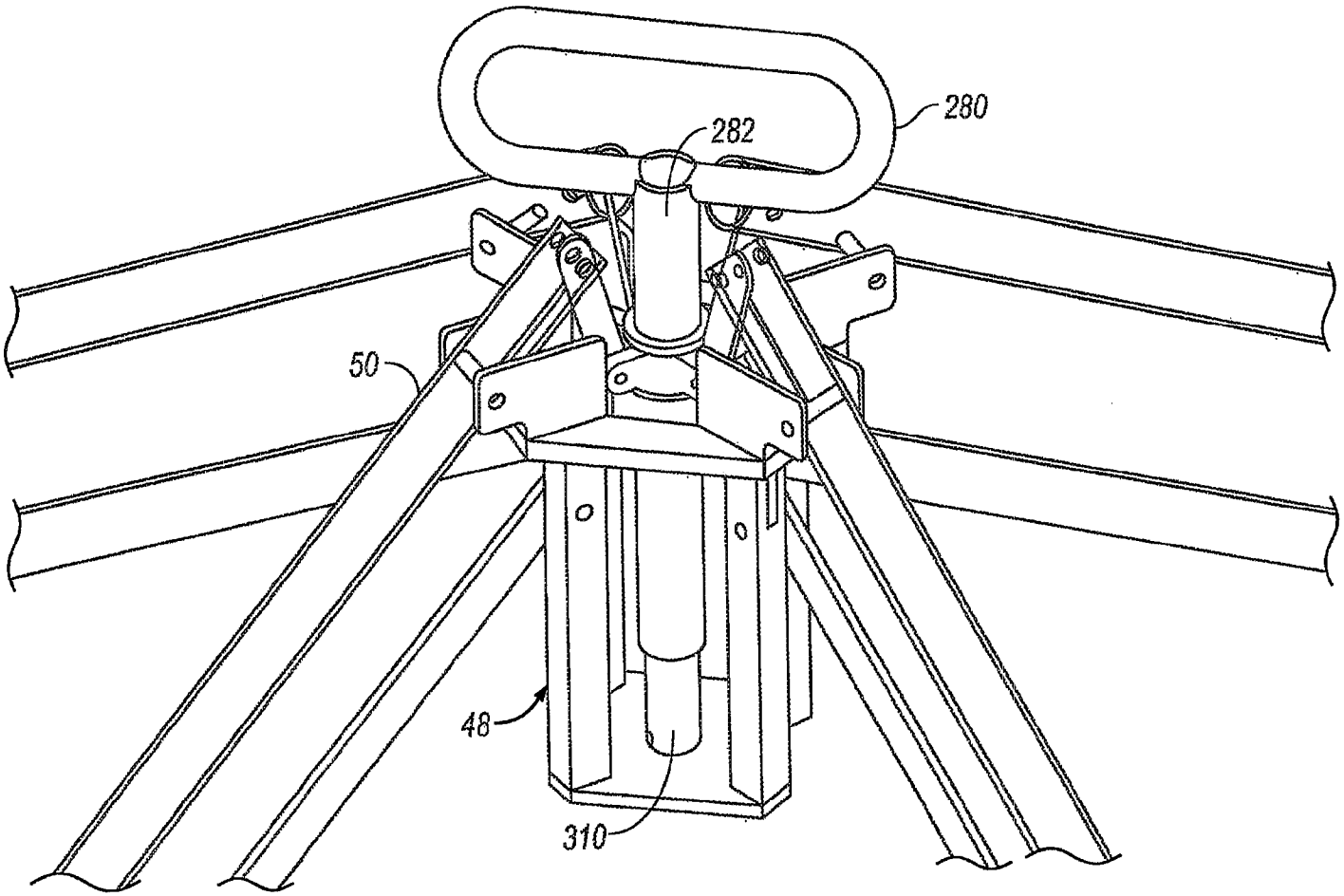
FIG. 28 is an enlarged isometric view of the hub assembly shown in FIG. 27.
Figure 29:
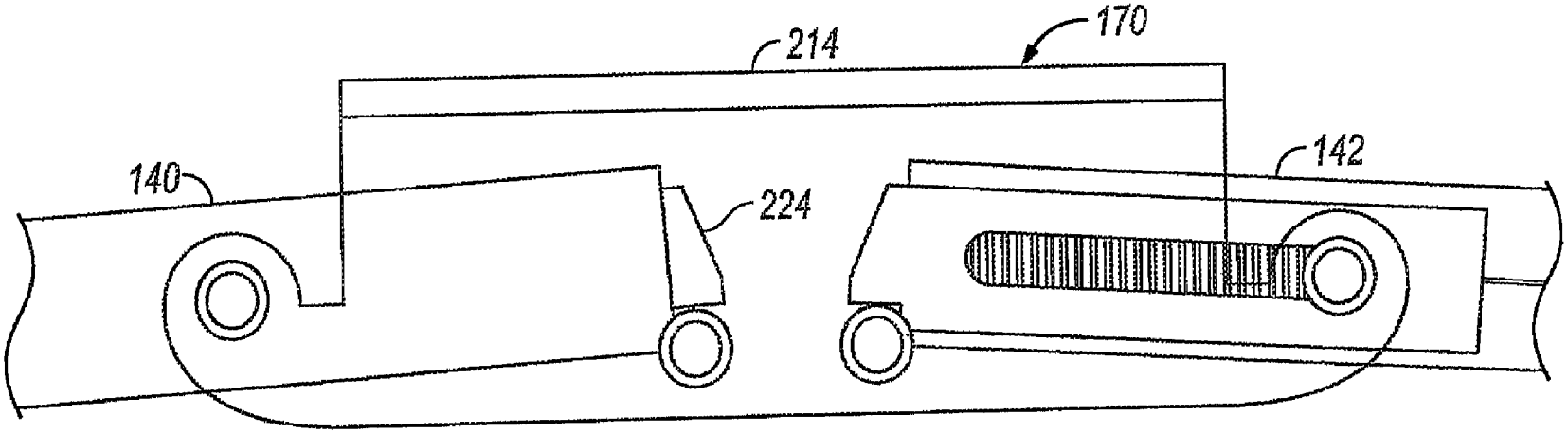
FIG. 29 is an enlarged elevation view of the latch connector shown in FIG. 27.
Figure 30:
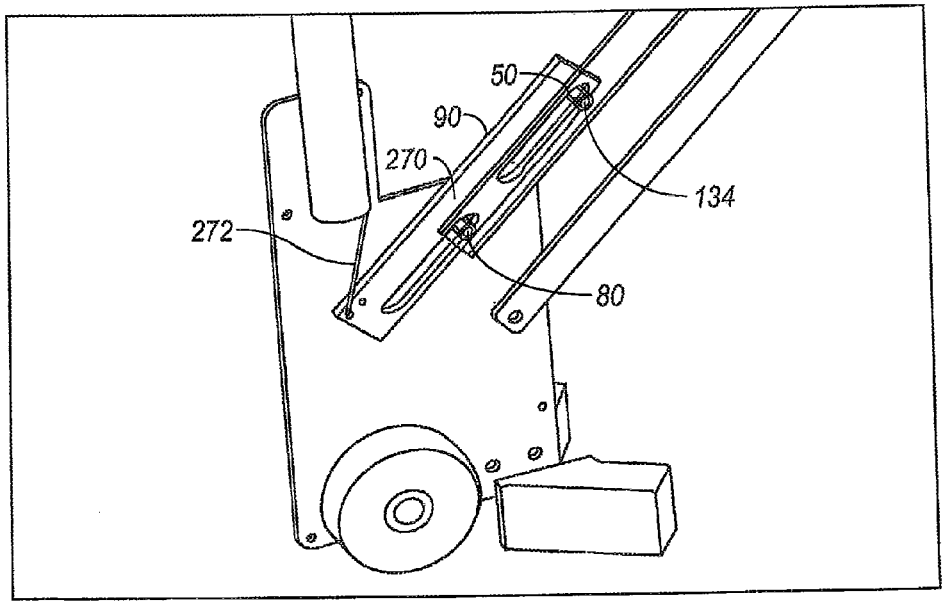
FIG. 30 is an enlarged isometric view of the partial lower corner assembly shown in FIG. 27.
Figure 31:
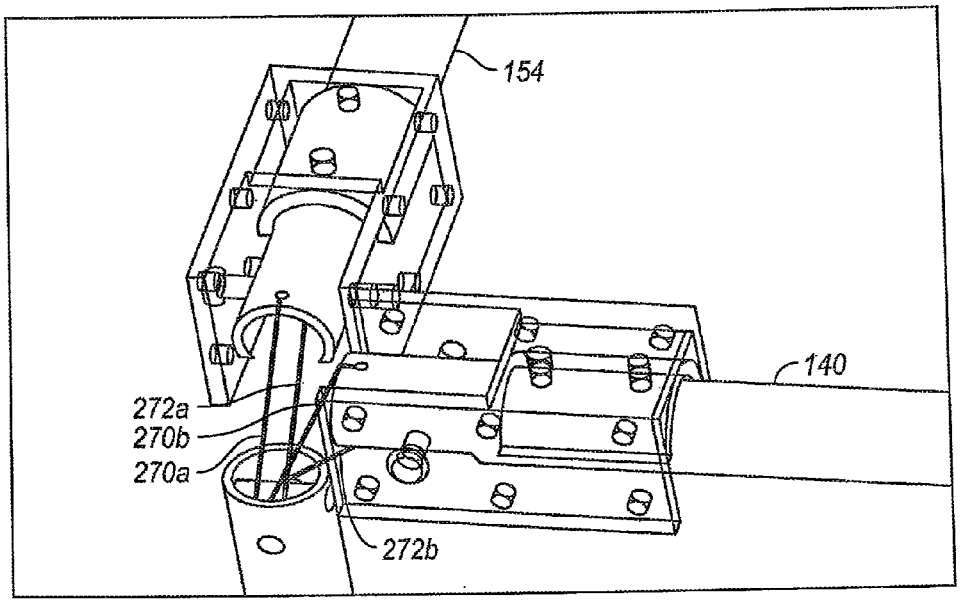
FIG. 31 is an enlarged isometric view of the partial upper corner assembly shown in FIG. 27.

The sequence of movement from the opened position toward the folded position is shown now in FIGS. 27-35. The lifting of the handle of the hub assembly, which may be accomplished with only one hand, rotates the base legs upwardly and relieves the tension in the frame allowing the upper arm to relax to a slightly upward position shown in FIG. 27. Referring to FIG. 28, the sleeve of the hub assembly is lower on the shaft and the links are raised so that the base legs are pivoted downwardly. Shown in FIG. 29, the upper arms are pivoted upwardly, but the slide bolt nosepieces are not yet retracted. Shown in FIGS. 30 and 31, the cables are tensioned by the rotation of the base legs. The left hand cam rivet 80 is still restrained in the recess of the left hand slot to keep the slider extended. When the hub assembly reaches about fourteen inches above the floor, the tension on the cables is sufficient to retract the slide bolt nosepieces to allow the upper arms to drop.

Figure 32:
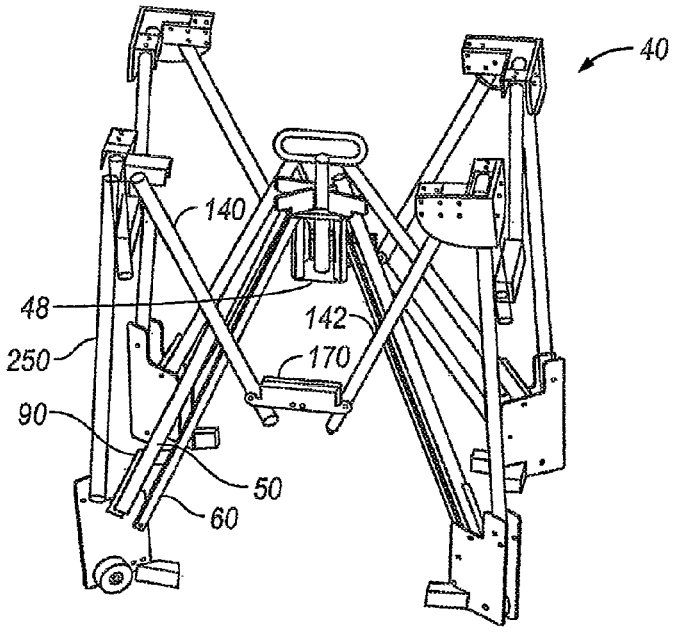
FIG. 32 is an isometric view of the frame as it moves further toward the folded position.
Figure 33:
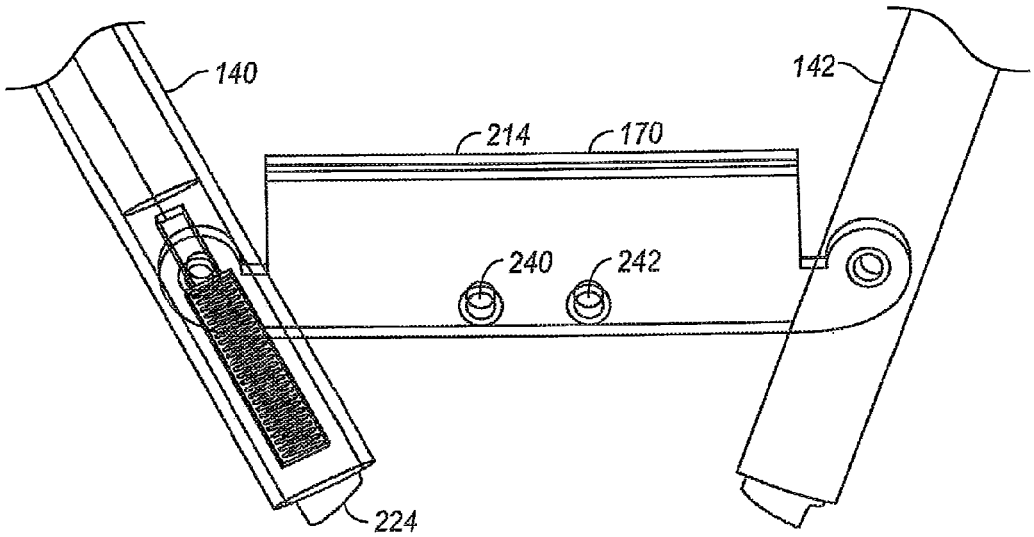
FIG. 33 is an enlarged elevation view of the latch connector shown in FIG. 32.
Figure 34:
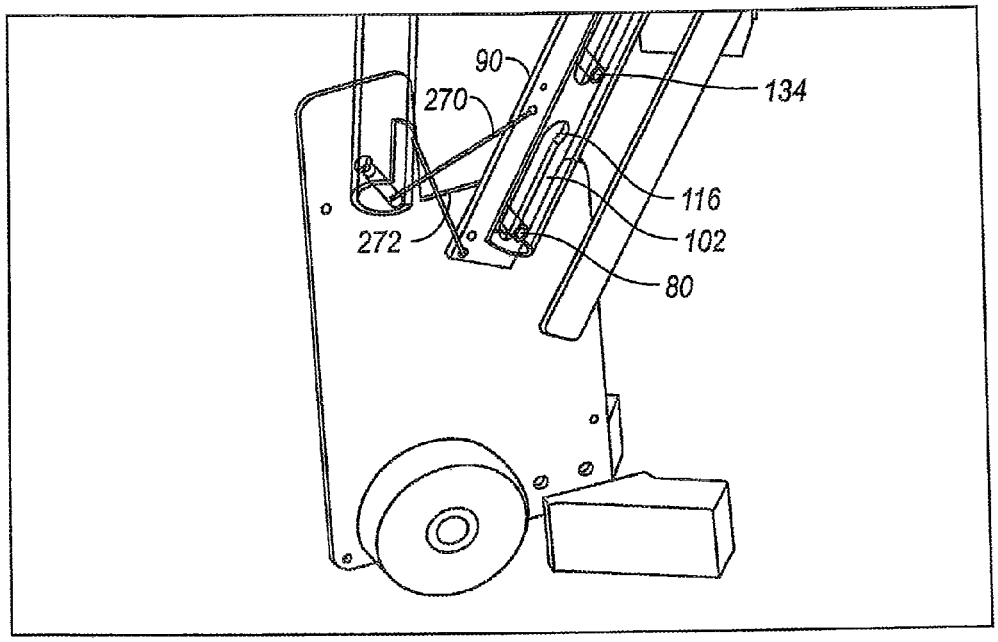
FIG. 34 is an enlarged isometric view of the partial lower corner assembly shown in FIG. 32.
Figure 35:
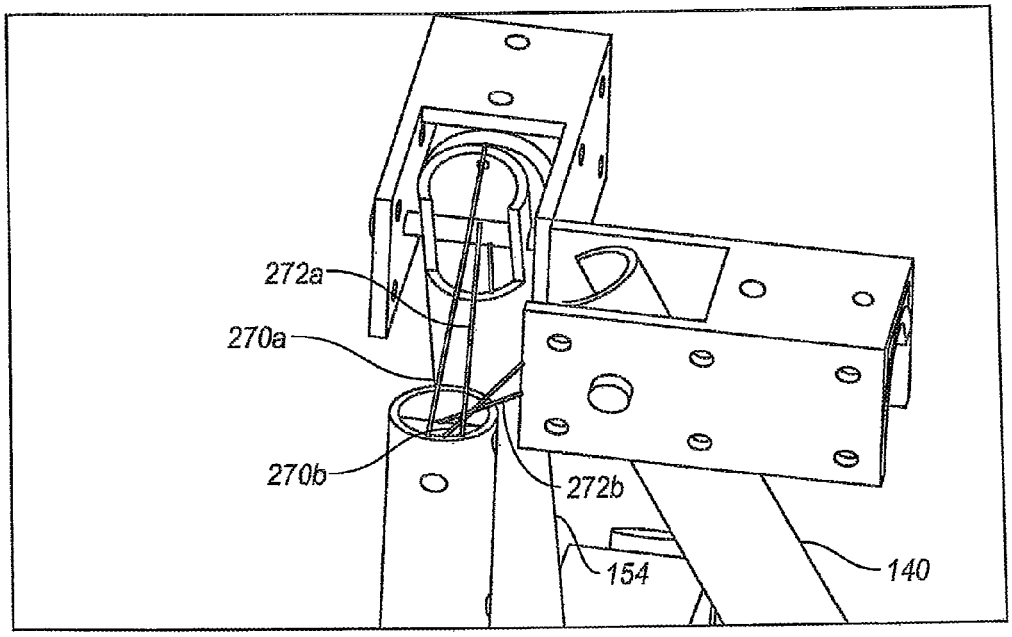
FIG. 35 is an enlarged isometric view of the partial upper corner assembly shown in FIG. 32.

When the hub assembly reaches about seventeen inches above the floor as shown generally in FIG. 32, the slider pops or snaps back along the upper base leg and the slide bolt nosepieces are released, but because they are spaced from the rivets 240, 242 latching does not take place. Shown in FIG. 33, the latch connector is shown in an opened position allowing the upper arms to rotate downwardly toward generally vertical positions. Illustrated in FIGS. 34 and 35, the slider is retracted to the right. When the hub assembly is fully raised about twenty inches above the floor as shown in FIG. 12, the frame is in the fully folded position.

When the frame is in the opened position as shown in FIG. 5, the base legs and the upper arms are generally in horizontal positions, and the side posts are generally in vertical positions. When the frame is in the folded position for storage and/or transport as shown in FIG. 12, the side posts remain in generally vertical positions, and the base legs and the upper arms are pivoted or rotated to more generally vertical positions. It is to be noted that the terms "generally horizontal" and "generally vertical" are meant to indicate approximation and that the referenced structures are at, or near, or about horizontal or vertical.

It should be noted that the dimensions of the slider is a function of the dimensions of the frame, and in particular of the base assembly, the side structure and the upper assembly, as well as the placement of the pivot rivets. Dimensions will also depend upon the desired movement of the various individual elements, the manner in which the cables are arranged and the amount of tension required in the cables. As will be described below in relation to FIGS. 45-49, a variation of the cam/cam follower configuration may also be used. It is also to be noted that the upper and lower base legs are not quite parallel because the distances between the pivot rivets 80 and 82 at the lower corner assembly 70 is slightly shorter than the distance between the pivot rivets 340 and 350 at the hub assembly even though the length of the upper base leg may be the same as the length of the lower base leg.

In an alternative variation as shown in FIGS. 36-39, the hub assembly may be motor driven or powered so that the enclosure is automatically operated. In the powered version of the enclosure, the hub assembly 400, FIG. 36, may include a top plate 402, four brackets 404, 406, 408, 410 connected to an underside of the top plate, a motor mount 412, a pulley drive 414, a lead or ball screw 416, a drive nut 418 linearly movable along the screw, four drive links 420, 422, 424, 426 pivotally connected to the drive nut with rivets (not shown) and pivotally connected to upper base legs with rivets, such as the rivets 428, 430 connecting the upper base legs 432, 434, and a screw mount 460. Lower base legs 436, 438, 440, 442, and connector links 444, 446, 448, 450 are also illustrated. The screw mount includes a bottom plate 462 and two vertical rods 464, 466 connecting the bottom plate to the top plate. A motor assembly has been removed from FIGS. 36-39 to enhance clarity.

Figure 36:
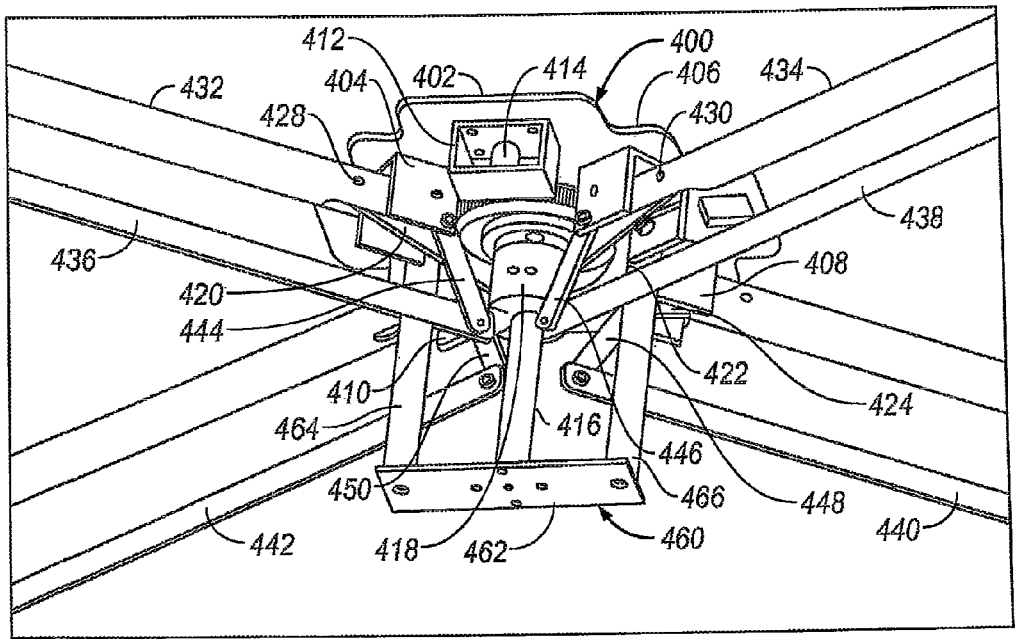
FIG. 36 is an isometric view of a powered hub assembly in an opened position.
Figure 37:
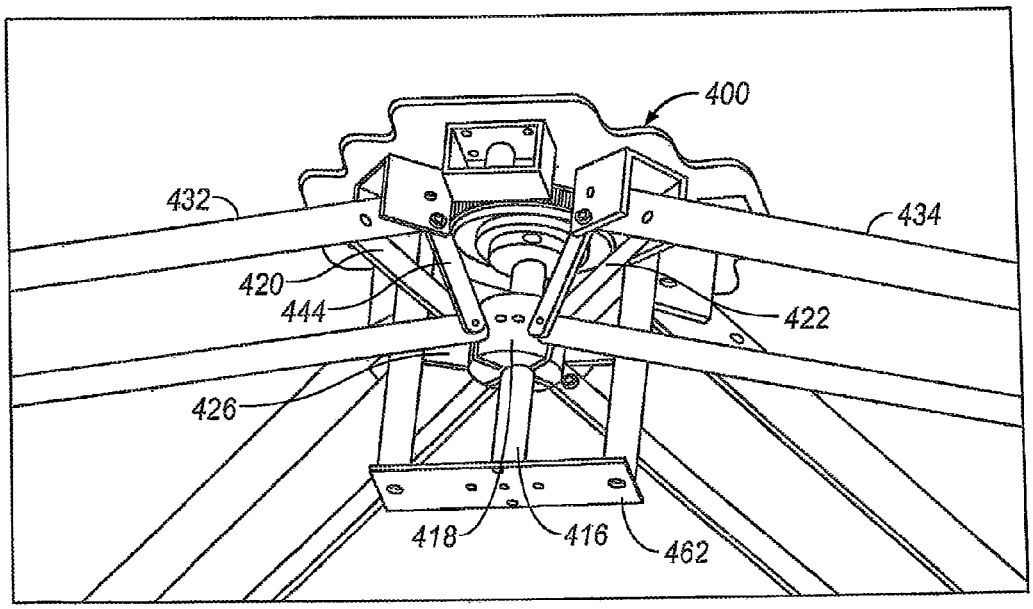
FIG. 37 is an isometric view of the powered hub assembly moving toward a folded position.
Figure 38:
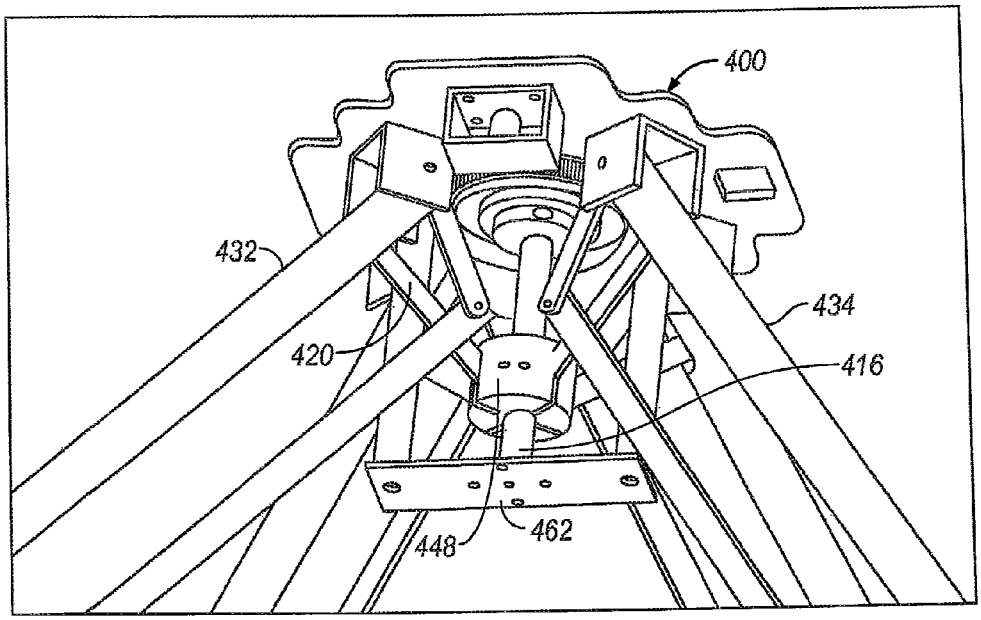
FIG. 38 is an isometric view of the powered hub assembly moving further toward the folded position.
Figure 39:
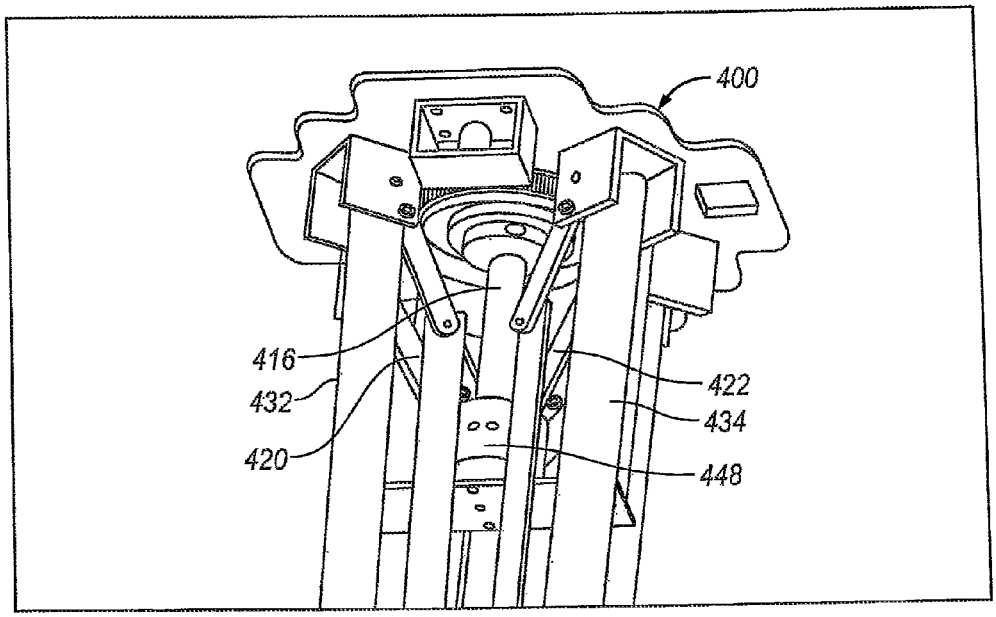
FIG. 39 is an isometric view of the powered hub assembly in the folded position.

Shown in FIG. 36, the base legs are generally horizontal as they would be when the frame is in a fully opened position. Illustrated in FIGS. 37 and 38, the hub assembly is raised toward the folded position as the drive nut 418 lowers toward the bottom plate 462 causing the drive links to pull on the upper base legs resulting in a downward rotation of the base legs. Illustrated in FIG. 39, the drive nut has reached its lowest position and the base legs have reached their folded, generally vertical positions. All of the other assemblies and structures of the frame operate generally as already described and shown above in relation to the manually operated hub assembly. A controller (not shown) may be mounted to one of the upper corner assemblies to actuate the powered hub assembly.

It is now apparent that the present invention offers a major advantageous feature, a one-step process, where pushing down on or lowering of the hub assembly opens the enclosure and pulling up on or raising the hub assembly folds the enclosure. This may be done automatically with a powered hub assembly or manually. In both opening and folding of the frame, movement in either direction of the hub assembly simultaneously causes movement of all of the remaining assemblies and structures of the frame, and this feature is another major advantage of the invention.

Alternative frame structures are diagrammatically referenced in FIGS. 40-49 where two variation embodiments of foldable frames are disclosed. In one of the variations shown in FIGS. 40-44, a frame 500 (of which only a one-quarter portion is shown and described in detail) includes a base assembly 502, a side structure 504, and an upper assembly 506. The base assembly is connected to a hub assembly (not shown) to which a motor may be connected, and four base legs, such as the base leg 508, extend in an "X" pattern like that described in relation to the frame shown in FIG. 5. Lower and upper corners assemblies are also present but not shown here.

The side structure includes four side posts, such as the post 510, forming a generally rectangular pattern as was also described in relation to the frame shown in FIG. 5. The upper assembly includes eight arms, connected in pairs, such as the arm 512, and the upper arms also form a rectangular pattern. Between each pair of arms are medial latch connectors, such as the latch connector 514.

Figure 40:
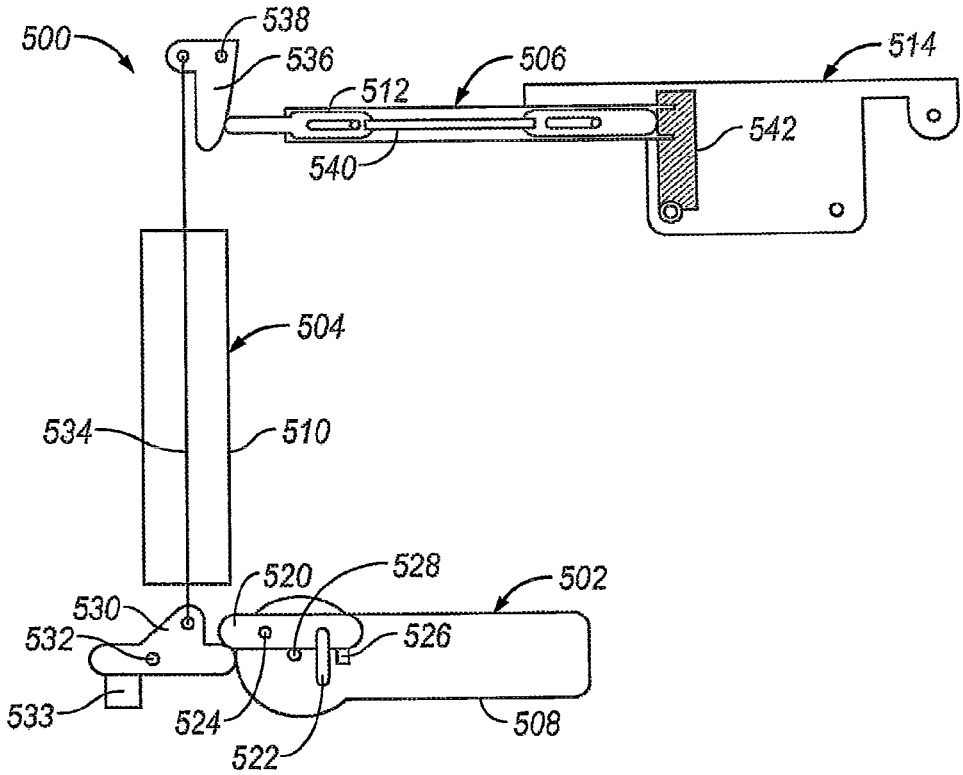
FIG. 40 is a schematic side view of a quarter portion of another embodiment of an enclosure frame shown in an opened position.

As with the frame embodiment shown in FIG. 5, the frame shown in FIG. 40, is in an opened or deployed position, where the base leg and the upper arm are generally in horizontal positions. The side posts are generally in vertical positions. When the frame is in the folded condition for storage and/or transport, the side posts are in generally vertical positions. The base legs and upper arms, however, pivot or rotate and are in more generally vertical positions.

At each lower corner may be a pair of plates (not shown) like those shown in the embodiment of FIG. 5, or a bracket, or the like, to which a base leg, such as base leg 508, and a side post, such as the side post 510, are connected using any suitable fasteners, such as rivets. The opposite ends of the base legs are connected to the hub assembly.

At each upper corner may be pairs of plates (not shown) connected at right angles like those shown in the embodiment of FIG. 5, or a bracket, or the like. An upper arm, such the upper arm 512, and a side post, such as the side post 510, are pivotally connected to the upper corner.

The base assembly includes a bar latch 520 and a connected spring 522, where both are connected to the leg 508, with the bar latch being pivotal about a rivet 524. A block 526 acts as a stop to downward or clockwise rotation of the bar latch. The base leg pivots around a rivet 528. The base assembly includes a lower spring-loaded latch 530 pivotally connected to the lower corner with a rivet 532, and a stop block 533 is provided to stop rotation of the lower link. A cable 534 extends from the lower link through the side post and connects to an upper spring-loaded link 536 that is part of the upper assembly. The upper link is pivotally connected to the upper corner by a rivet 538. A slide link 540 is slideably positioned in the upper arm and is connected to a spring-loaded lock bar 542. The lock bar is pivotally connected to and is a part of the latch connector 514.

Figure 41:
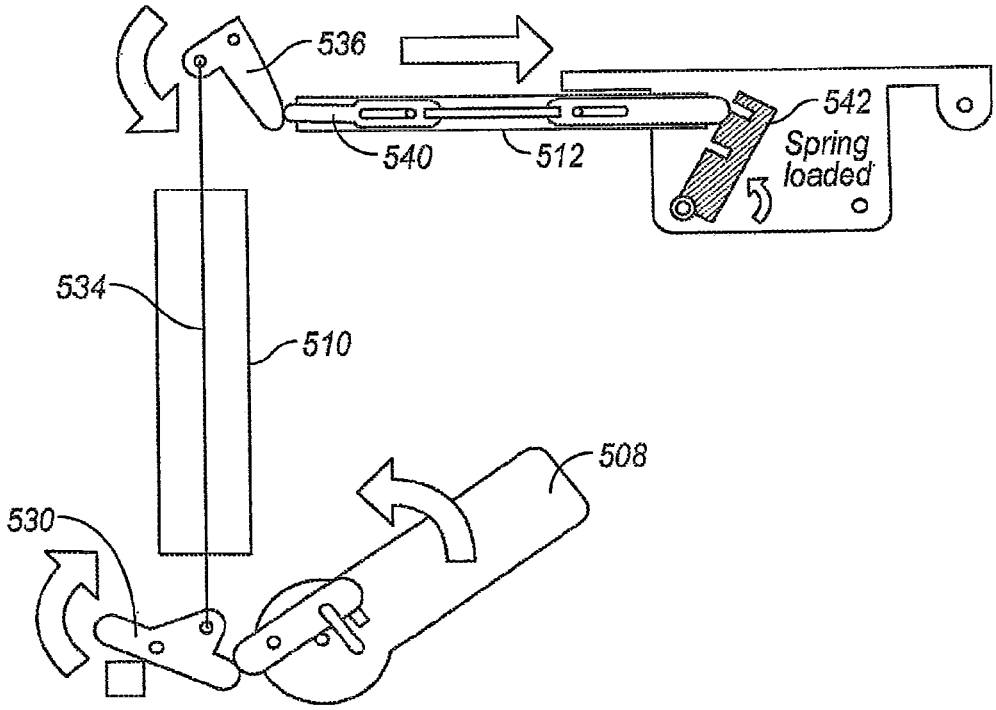
FIG. 41 is a schematic side view of the frame shown in FIG. 40, as the frame begins to fold.

In operation, the frame is shown in an opened condition in FIG. 40, with the base leg, the bar latch, the lower link, and the upper arm in generally horizontal positions. The lock bar, the upper link and the cable are in generally vertical positions. The lock bar, as shown, is secured to the upper arm in a locking mode. When the frame begins to fold, as shown in FIG. 41, after the motor is actuated or a manual crank is turned, the base leg rotates or pivots counterclockwise causing the lower link to rotate or pivot clockwise and to load the lower link spring (not shown). The pivoting lower link pulls on the cable causing the upper link to rotate or pivot counterclockwise and to load the upper link spring (not shown). The pivoting upper link moves the slide link to the right as shown in the FIG. 41, to cause the link to push on the lock bar, unlock the upper arm, and load the lock bar spring.

Figure 4:
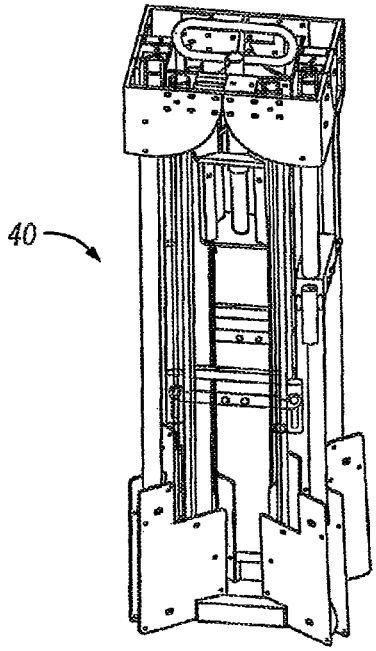
FIG. 4 is an isometric view of the frame shown in FIG. 3 in a folded position.
Figure 42:
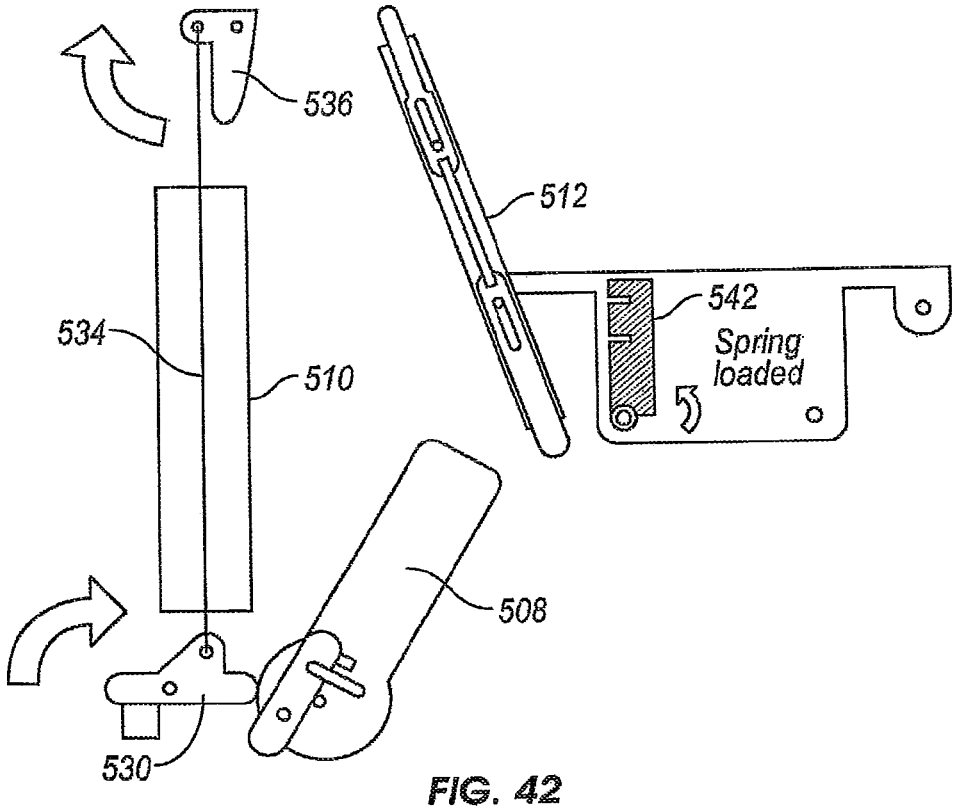
FIG. 42 is a schematic side view of the frame shown in FIGS. 40 and 41, as the frame nears a completely folded position.

The base leg continues to move upward to a more upright position as shown in FIG. 42, while the upper arm moves downwardly to a generally vertical position. Meanwhile, the lower link, the upper link, and the lock bar are all biased back to their initial positions by their respective springs. These movements enable the frame to reach a folded condition as shown in FIG. 4.

Figure 43:
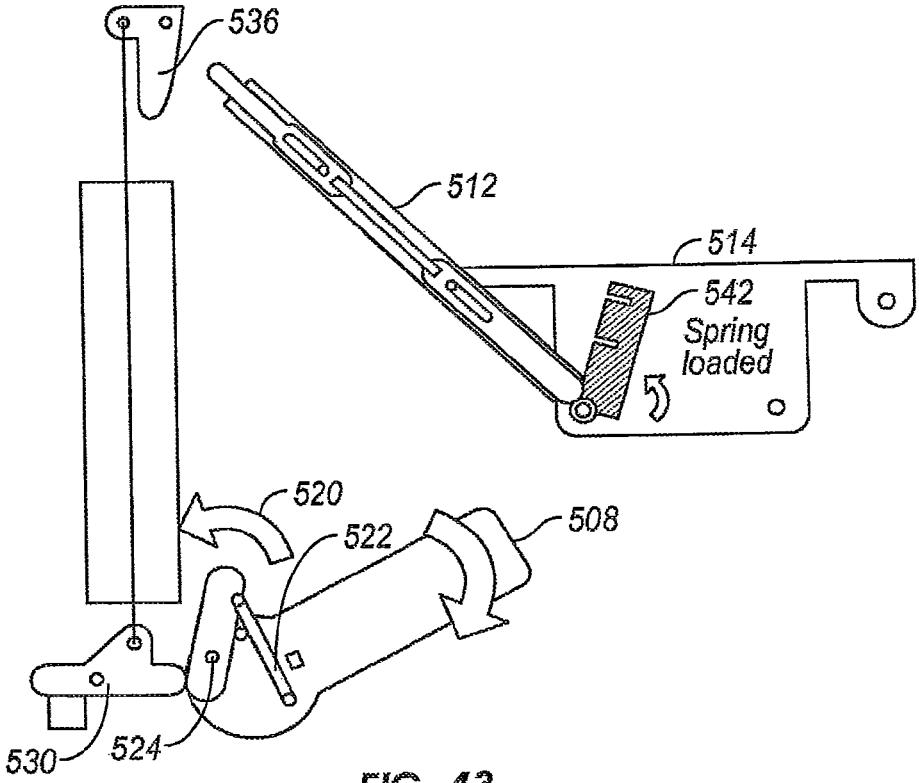
FIG. 43 is a schematic side view of the frame shown in FIGS. 40-42, as the frame moves from the folded toward the opened position.
Figure 44:
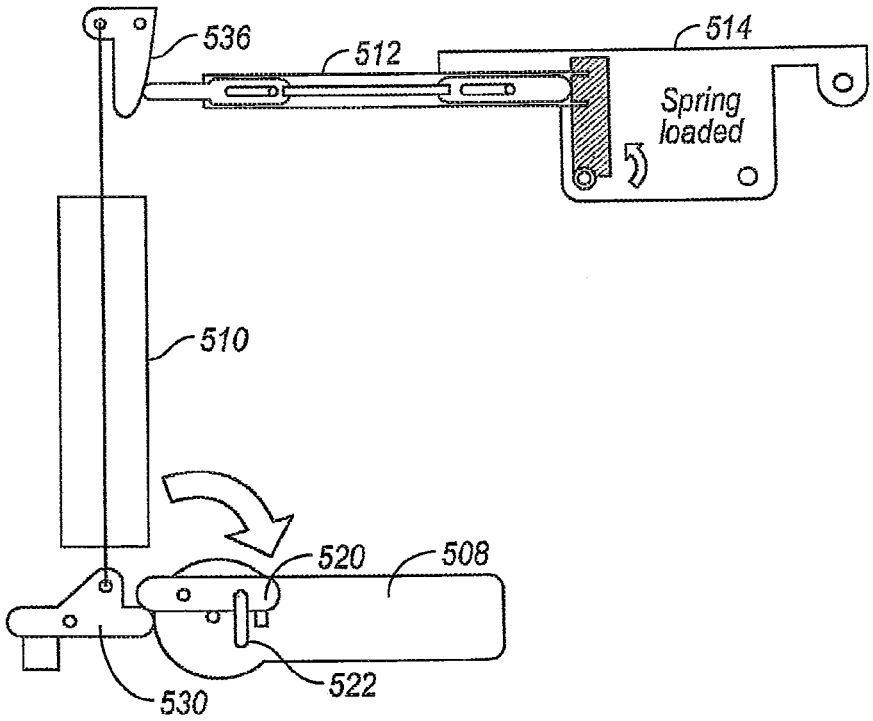
FIG. 44 is a schematic side view of the frame shown in FIGS. 40-43, when the frame reaches the fully opened position.

To open the folded frame, the motor is again actuated, or the crank is turned, so that the hub assembly lowers the base legs to cause the base leg 508 to rotate clockwise as shown in FIG. 43. The bar latch engages the lower link and pivots counterclockwise around the rivet 524 while loading the bar latch spring 522. In the meantime, the upper arm and the latch connector also move upwardly until the upper arm snaps into a locking position with the lock bar at the fully raised position shown in FIG. 44. The base leg continues to move downwardly, the bar latch 522 passes the lower link 530, and the bar latch snaps back to its initial position, also as shown in FIG. 44, under the influence of the biasing spring 522.

Another alternative embodiment is shown in FIGS. 45-49, and includes a base leg 550 connected to a cam wheel 552, where both are attached to a lower corner assembly and are allowed to pivot around a rivet 554. The cam wheel includes a backward J-shaped slot 556 that mates with a cam-follower link 558 attached to a pivot rivet 560 at a lower end. A cam-follower rivet 562 is attached at a mid-portion of the link, and a cable connection 564 is formed at an upper end portion of the link. A cable 566 extends from the cam-follower link, through a side post 568 to an upper arm 570. As with the embodiment shown in FIGS. 40-44, a slide link 572 is moveably located in the upper arm. A spring-loaded lock bar 574 mounted to a latch connector 576 completes the relevant structure of a quarter portion of a frame similar to that described above relative to the embodiments shown in FIGS. 5 and 40.

Figure 45:
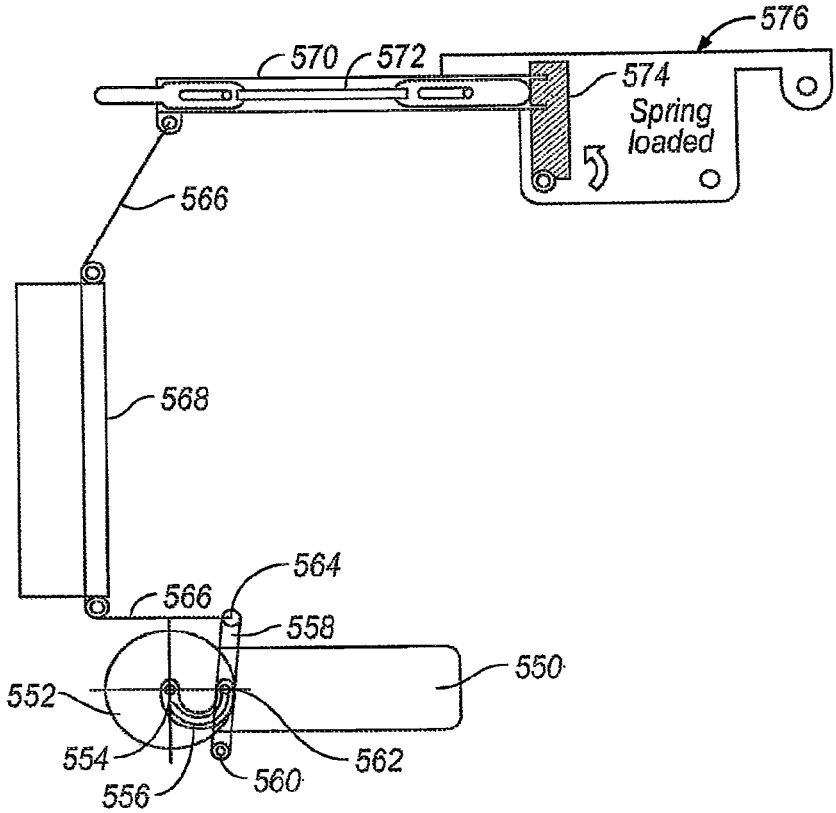
FIG. 45 is a schematic side view of a quarter portion of still another embodiment of an enclosure frame shown in an opened position.

In operation, with the frame is in an opened position as shown in FIG. 45, where the base leg and the upper arm are in generally horizontal positions, and the lock bar and the cable are in generally vertical positions. The lock bar is shown secured to the upper arm in a locking mode. When a connected hub assembly is moved upwardly to cause the frame to fold, the base leg rotates or pivots counterclockwise causing the cam wheel to pivot the cam-follower link so that tension is applied to the cable. The pivoting cam-follower link pulls on the cable causing a leftward pull on the slide link in the upper arm to cause the upper arm to disengage from the lock bar, and the upper arm is allowed to rotate downwardly to a generally vertical position.

Figure 46:
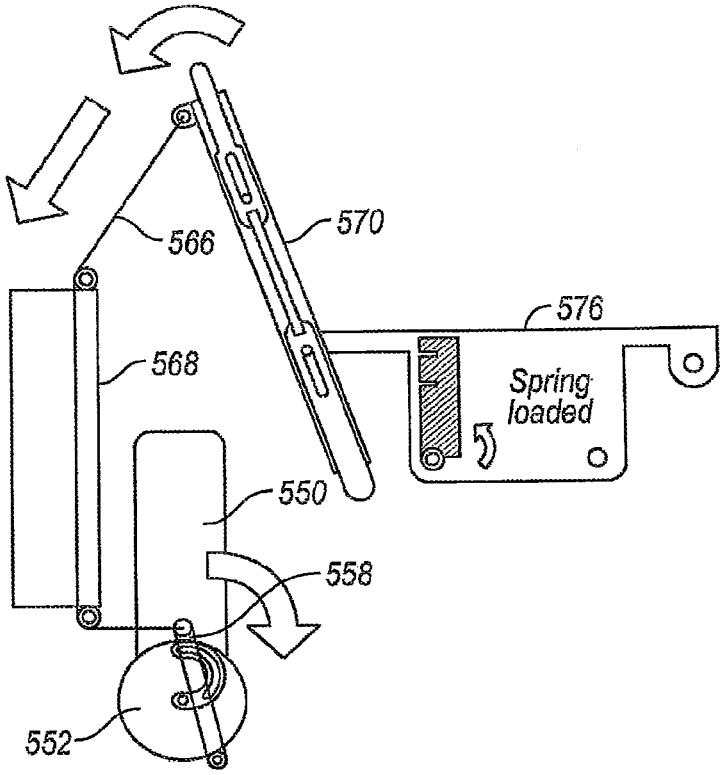
FIG. 46 is a schematic side view of the frame shown in FIG. 45 in a nearly a folded position, as the frame moves to an opened position.
Figure 47:
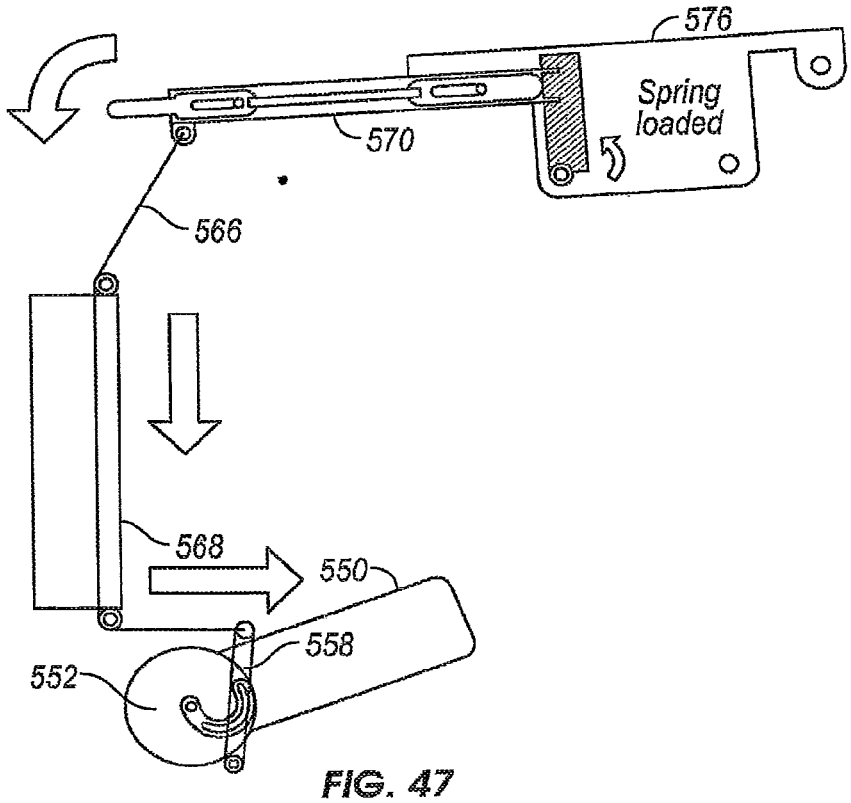
FIG. 47 is a schematic side view of the frame shown in FIGS. 45 and 46, when the frame has reached a position to lock its upper assembly as the frame moves toward the opened position.
Figure 48:
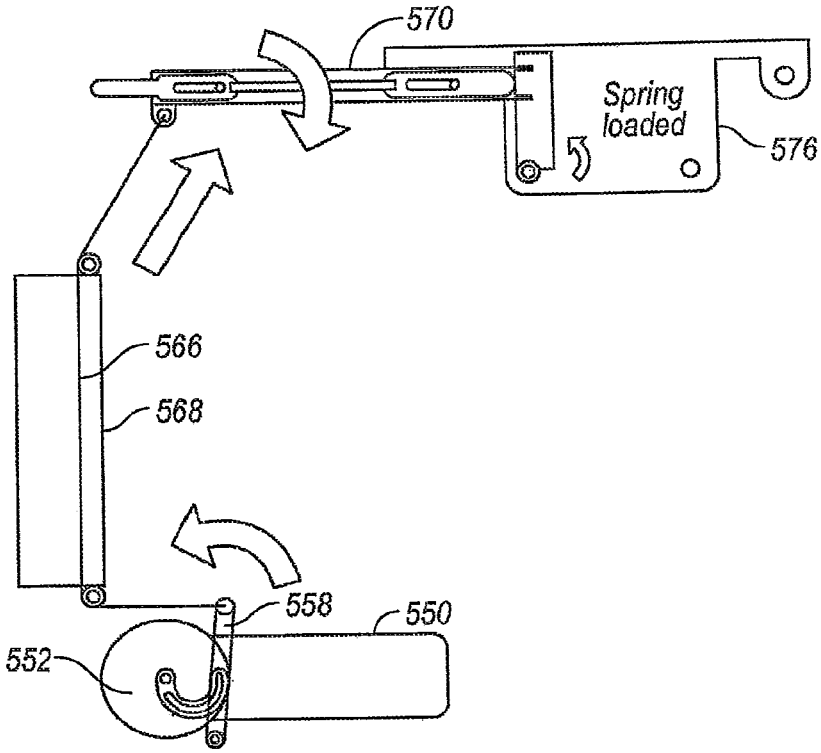
FIG. 48 is a schematic side view of the frame shown in FIGS. 45-47, as the frame reaches the opened position.

To open the folded frame, the motor is again actuated or the crank is turned at the hub assembly to rotate the base leg clockwise as shown in FIG. 46. This clockwise motion tensions the cable to pull the upper arm in a counterclockwise rotation so as to lift both the upper arm and the latch connector. When the base arm drops to about 60.degree. from a vertical reference line, such as that represented by the side post shown in FIG. 47, the upper arm and the latch connector rotate to a position slightly above horizontal by several degrees, and the lock bar snaps to a locking position with the upper arm under the influence of the lock bar biasing spring. Continued clockwise rotation of the base leg causes the cam-follower link to relax the cable and allow the upper arm and latch connector to rotate clockwise back to a horizontal position as shown in FIG. 48, while the base leg also reaches a generally horizontal position.

Figure 49:
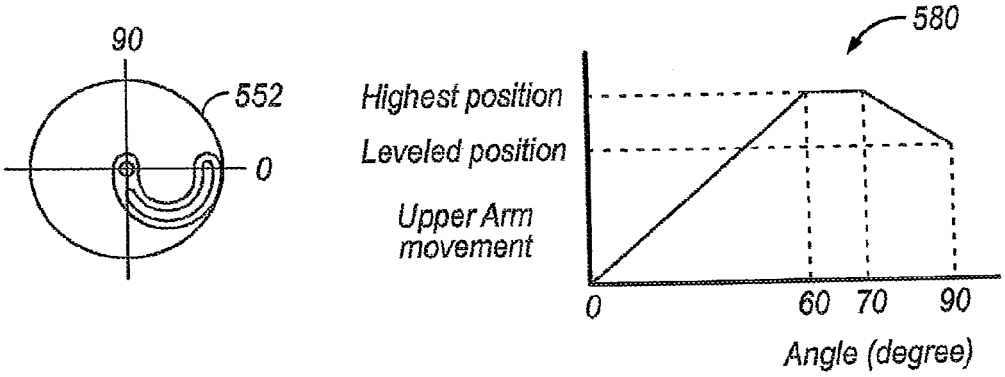
FIG. 49 is a schematic side view of a cam wheel shown in FIGS. 45-48, and a graph illustrating the position of the upper assembly of the frame in relation to the rotational position of the cam wheel.

As may be appreciated, the cam wheel with the backward J-shaped slot controls the movement of the cam-follower link and the movement of the attached cable. As shown in FIG. 49, there is illustrated the cam wheel 552 and a graph 580 that charts the position of the upper arm as a function of rotation of the cam wheel. The graph shows that the upper arm reaches a higher than horizontal position when the cam wheel has rotated between 60.degree. and 70.degree.; further rotation of the cam wheel to 90.degree. returns the upper arm back to a level or horizontal position.

Two alternative motor assemblies are shown in FIGS. 50-57. One of the alternative motor assemblies is shown in FIGS. 50-53. The motor assembly may form a hub assembly and may include a motor and gear box 600, a spring loaded clutch 602, a clutch lever 604, a mode selector 606, a gear train 608, a manual handle 610, a lead or ball screw 612, with a follower drive nut 614, and a housing 616. Base legs 618 and 620 of a frame are connected to the drive nut, and the base legs pivot and move in response to linear movement of the drive nut.

Figure 50:
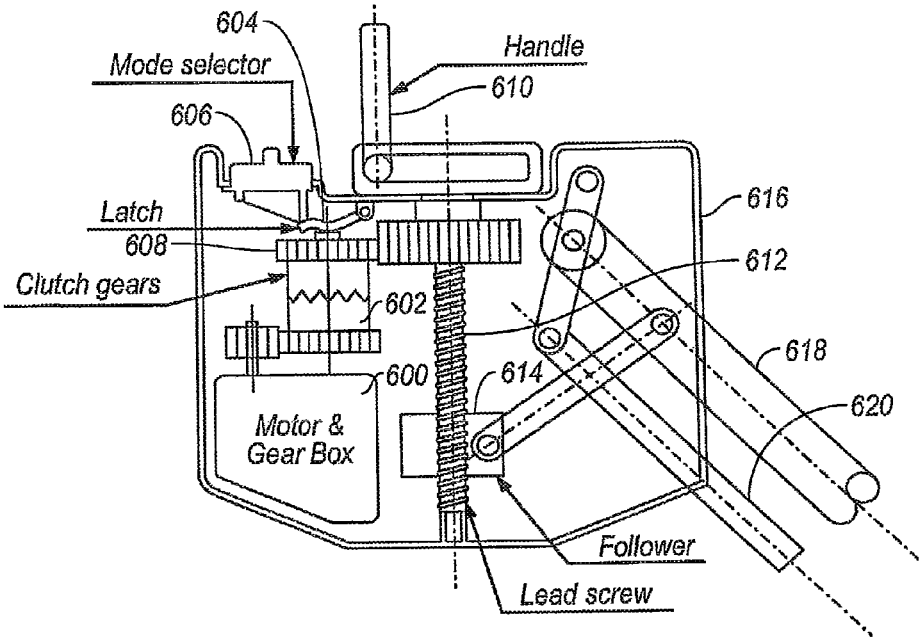
FIG. 50 is a schematic plan view of a motor assembly embodiment.
Figure 51:
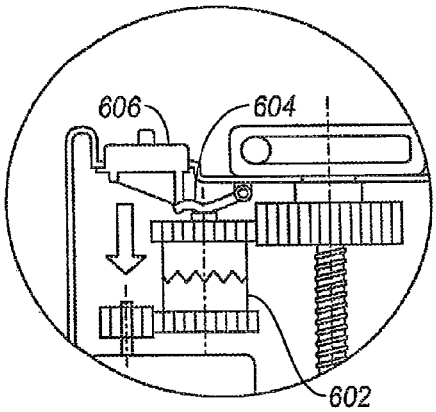
FIG. 51 is a partial schematic plan view of a clutch of the motor assembly shown in FIG. 50, in an engaged position.
Figure 52:
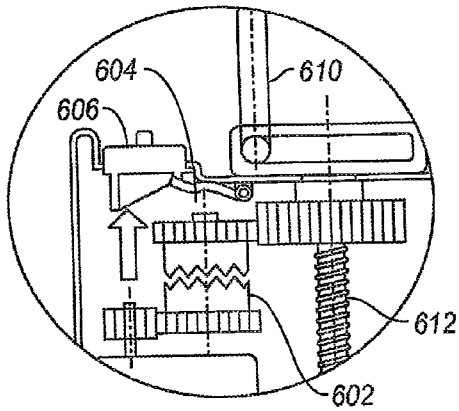
FIG. 52 is a partial schematic plan view of the clutch shown in FIG. 51, in a disengaged position.
Figure 53:
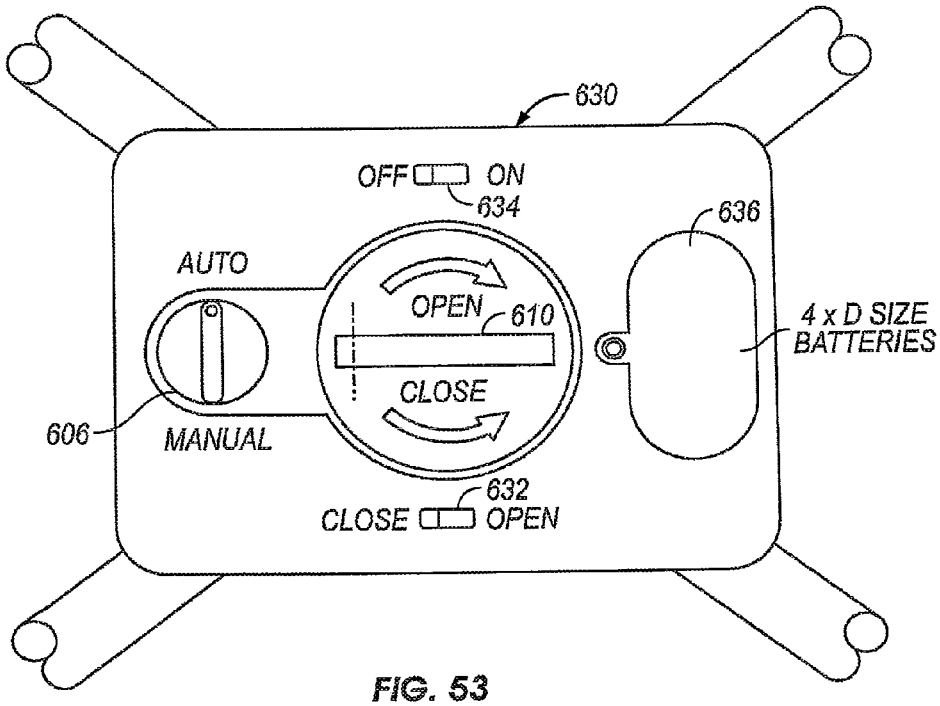
FIG. 53 is a schematic plan view of a cover of the motor assembly shown in FIG. 50.

The motor assembly allows automatic (motor driven) or manual operation. When the clutch is engaged as shown in FIGS. 50 and 51, the motor is able to drive the screw and thereby the drive nut. When the clutch is disengaged as shown in FIG. 52, the motor is not operatively connected to the screw. However, a user may rotate the handle and thereby drive the screw. A controller or control panel 630 is shown in FIG. 53, and includes the handle 610, an open/close play yard switch 632, the mode selector 606, an on/off switch 634, and a battery compartment 636.

Figure 54:
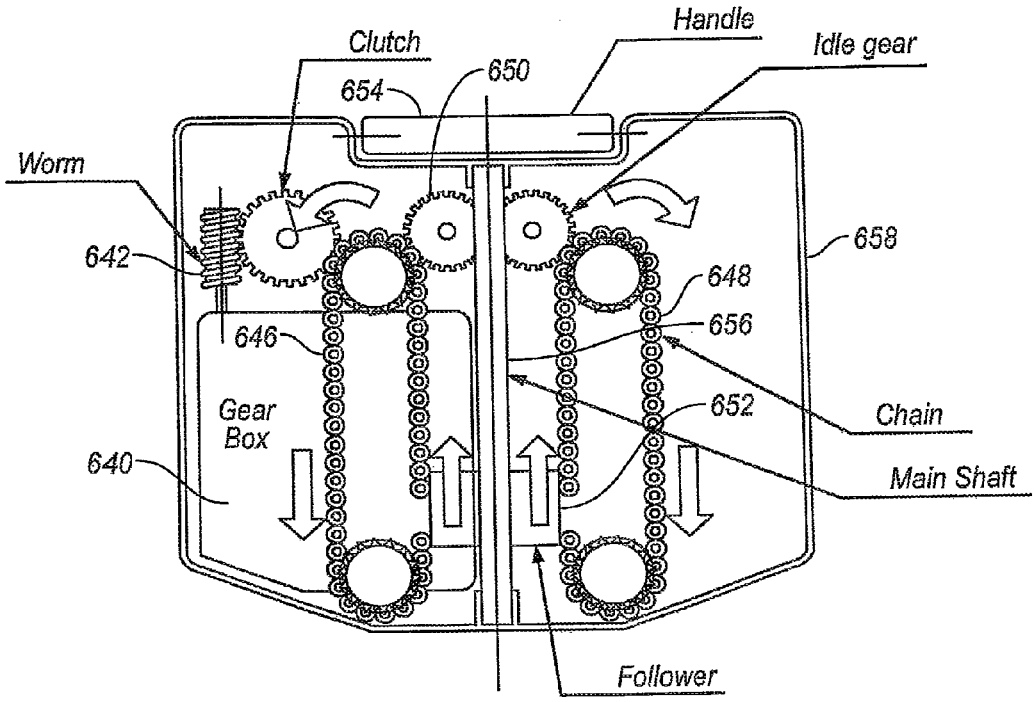
FIG. 54 is a schematic plan view of another motor assembly embodiment.
Figure 55:
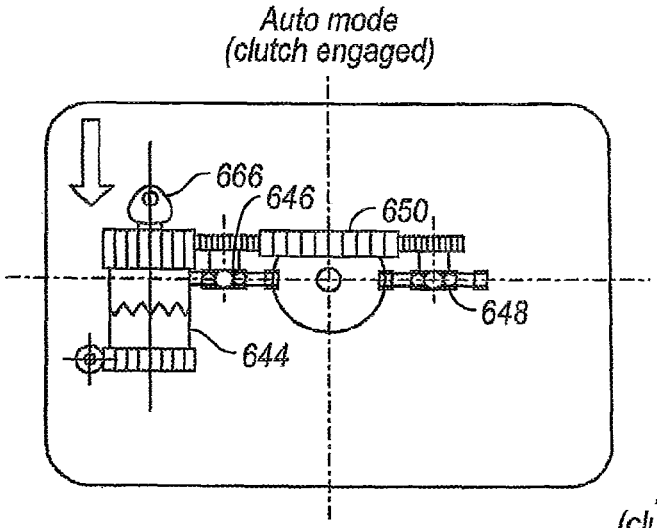
FIG. 55 is a schematic elevation view of an engaged clutch of the motor assembly of FIG. 54.
Figure 56:
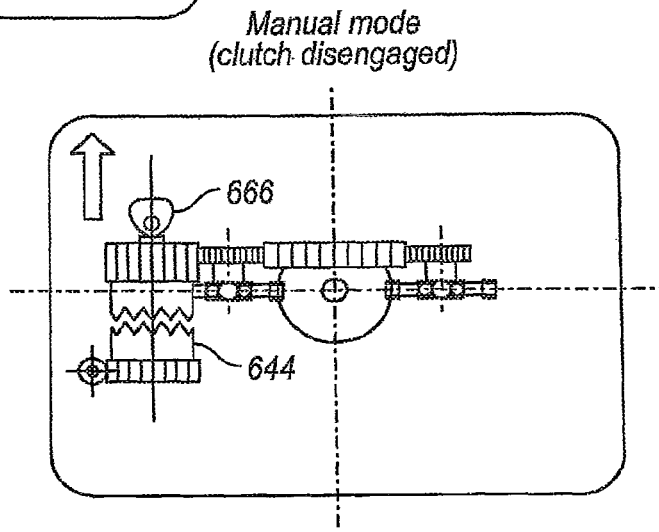
FIG. 56 is a schematic elevation view of the clutch shown in FIG. 55, in a disengaged position.
Figure 57:
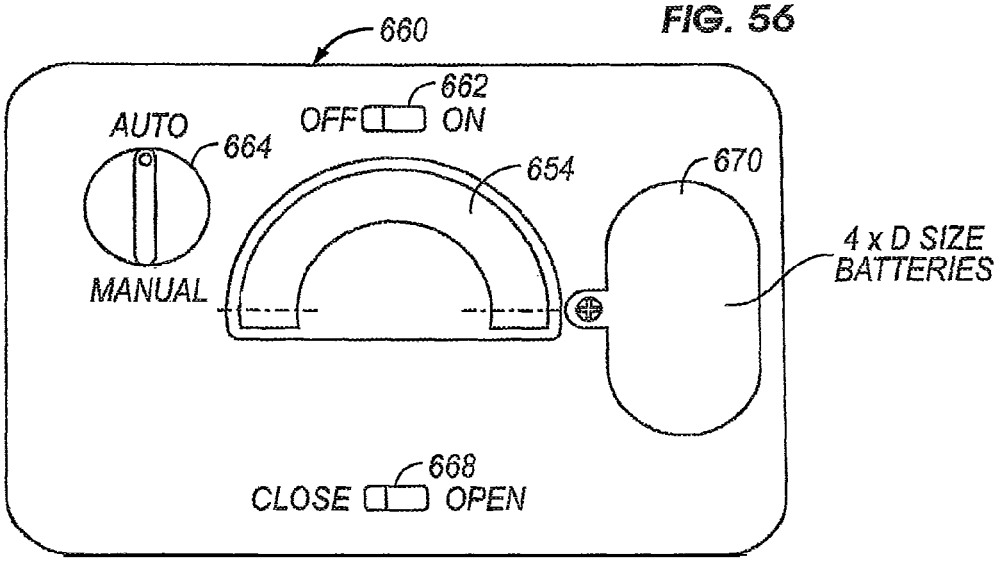
FIG. 57 is a schematic plan view of a cover of the motor assembly shown in FIG. 54.

The other motor assembly embodiment is shown in FIGS. 54-57, and may include a motor and gear box 640, a worm gear 642, a cam operated clutch 644, a first chain drive 646, a second chain drive 648, a set of gears 650, a follower 652, a manual handle 654, a central shaft 656, and a housing 658. As with the motor assembly shown in FIG. 50, the motor assembly shown in FIG. 54 also allows automatic, motor drive or manual operations. When the clutch is engaged, as shown in FIGS. 54 and 55, the motor is able to move the chain drives through the set of gears, and the chain drives move the drive nut. When the clutch is disengaged, as shown in FIG. 56, the legs may be manually manipulated between the open and closed positions. As with the embodiment shown in FIG. 50, base legs (not shown in FIG. 54) are operatively connected to the motor assembly. Referring to FIG. 57, a controller or control panel 660 is shown, having the handle 654, an on/off switch 662, a mode selector 664 to rotate a cam 666, FIGS. 55 and 56, an open/close switch 668 and a battery compartment 670.

In accordance with various aspects of the present invention, the controller used to control the motor to cause the deploying or opening and the collapsing or folding movements of the play yard may be constructed and configured to have two or more discrete switches (not shown) which need to be actuated simultaneously, or in a predetermined sequence or pattern, to effect actuation of the motor and thereby of the movable components of the play yard, so as to prevent inadvertent movement of the play yard toward its deployed and/or collapsed positions. The two or more discrete switches are preferably spaced sufficiently apart from one another, or otherwise disposed relative to one another, so as to prevent inadvertent actuation of one switch upon actuation of the other switch.

The controller may be constructed to require that one switch, or a combination of switches, be engaged throughout the opening and/or folding operations. Alternatively, the controller may be constructed such that only one actuation of a switch or switches is required to effect full movement of the play yard between its fully-deployed or open and/or fully-collapsed or folded positions. As a further alternative, the controller may be constructed to move the play yard to a position intermediate its fully deployed and/or fully collapsed positions, such as a midway position, with one actuation of a switch or switches, and further or complete movement of the play yard to its fully deployed and/or fully collapsed positions requiring a subsequent actuation of a switch or switches.

The controller may be constructed to automatically switch directions with each successive actuation. For example, should the movement of the play yard toward the fully-collapsed position be stopped at an intermediate point, such as upon a user noticing a toy in the play yard which is to be removed, but which has been enclosed by the partially-collapsed play yard, the user need only release the switch or switches and reengage them for movement in the opposite, toward the fully-deployed, condition. The motor may then be stopped and re-actuated for movement of the play yard to its fully collapsed position.

The controller may be mounted on the frame of the play yard, such as at a corner or elsewhere on the play yard, or alternatively, the controller may be separate from the play yard, such as on a key fob or other portable device, and operated using wireless technology. This may facilitate the ability of a user to hold a child or baby with both arms throughout the deployment and/or collapsing of the play yard.

The controller may be configured and constructed utilizing any of a wide variety of known controller designs and/or mechanisms. For instance, the controller may utilize electrical contact switches and/or may utilize a processor, microprocessor or microcontroller, each of which is well known in the art.

The controller may operate in conjunction with one or more sensors, such that upon actuation, or lack of actuation, of one or more sensors the motor does not operate even when the one or more switches, or other control actuation mechanism, which would normally actuate the motor, are properly actuated.

The controller may also be provided with switches or other actuators for controlling additional items such as a timer, an alarm clock feature, a music device, a monitor, or any other desirable items. If desired, a general auxiliary device connector may be provided through which various auxiliary devices may be interchangeably connected and controlled by the controller, which devices may be powered by the power source for the play yard, or through an independent power source.

In accordance with another aspect of the invention, the power source for driving the motor may be a replaceable and/or rechargeable battery or batteries, conventional battery or batteries, and/or a direct electrical supply, such as that available from an electrical outlet. To keep the overall play yard relatively low in weight and/or to keep production costs down, or for other reasons, a relatively small power source may be utilized which has sufficient power to move the play yard back and forth between its deployed and collapsed positions, but which does not have sufficient additional power to regularly or routinely power additional accessories or onboard systems without draining its power undesirably quickly. Alternatively, a larger power source may be utilized which not only has sufficient power to move the play yard back and forth between its deployed and collapsed conditions, but also has additional capacity to drive one or more additional accessories and/or onboard systems, which accessories and/or onboard systems may be integral with the play yard or may be modular additions or connections to the play yard, without draining power too quickly.

In accordance with yet another aspect of the invention, a display may be utilized in conjunction with the play yard, which display or a portion thereof may be mounted onboard the play yard or be remote, to provide visual and/or audio feedback to the user about any desired feature or parameter, such as the position of the play yard frame, the state of the latches, the presence of an object in the play yard, whether the play yard will move toward its deployed or collapsed position when next actuated, the presence of a baby or child in the play yard, instructions for use and operation of the play yard, emergency telephone numbers, environmental conditions within the play yard, or any other desired feature or parameter.

In accordance with still another aspect of the invention, one or more object sensors may be utilized in conjunction with the play yard, with the object sensor or sensors having the ability to detect the presence of object within the interior portion of the play yard and to interrupt and/or prevent movement of the play yard in the direction toward its collapsed position when the object sensor detects the presence of an object within the interior portion of the play yard. The object sensor or sensors may be of any known type, or any type later developed, such as a mechanical weight sensor, a proximity sensor, a motion sensor, a light beam sensor, or any other device having the ability to detect the presence of an object within the interior of the play yard. The sensor or sensors may be electronic and may send a signal which is electrically acted upon to prevent or interrupts power to the motor, and/or the sensors may be mechanical and actuate a physical lock or a brake to prevent further folding or the full folding movement of the play yard. Mechanical sensors are particularly well suited for use in non-powered play yards, or in powered play yards having a non-powered mode of operation.

Since it is common for play yards to utilize a bottom mat, pad or mattress on the base or lower surface of the play yard, the sensor may be designed and/or configured to account for the presence of the mat or the like, and not regard or detect the mat or the like, as an object and therefore not prevent the folding movement with the mat or the like present. The mat or the like may be designed to fold within the play yard, or alternatively, the object sensor or sensors may be designed and/or configured to not account for the presence of the mat or the like and prevent folding movement of the play yard when the mat or the like is present.

Sensors may also be used to detect the presence of modular add-on devices connected to the play yard, such that movement of the play yard to its collapsed position is prevented when a connected add-on is detected, thereby preventing potential damage to the add-on device.

In accordance with a further aspect of the invention, position sensors may be utilized at selective locations on the frame to send a signal indicative of the positions of one or more components or elements of the play yard. The position sensors can be used for several purposes, such as sending a signal to a display to provide a visual and/or audio indication to the user as to the current position or of the deployment or the collapsing of the play yard and/or to provide an interrupting signal (or non-signal) if a position sensor or sensors are not engaged as they would be during proper deployment and/or collapsing of the play yard. Any one or more of several known types of sensors may be utilized, such as rotary encoders at any one or more frame component pivot points, and/or limit or contact switches which are engaged as selective elements of the play yard move to their proper positions, or improper positions, during deployment and/or collapsing of the play yard. By way of example, positions sensors may be mounted to the play yard at positions which provide indication that the play yard has moved to its fully deployed position, its fully collapsed position, or any position in-between; and/or position sensors may be mounted at locations to detect the engagement or lack of engagement of latches. Position sensors may operate in conjunction with electronic timer controls such that a signal to effect stoppage of power to the motor is sent if the position sensor is not engaged within a predetermined time period.

The motor may be of a reversible type, or alternatively, a single-direction motor with mechanical reversing means.

Instead of cables, or in addition to cables, hydraulic or pneumatic lines may be utilized, which may allow one tube to be run through an interior of a post for effecting movement in both deployed and collapsed directions to eliminate the need for using two separate cables to effect movement in the deployed and collapsed directions. Cables or hydraulic lines or control wires may be disposed interiorly within the posts, and wheels or other suitably arcuate surfaces may be provided at locations of sharp turns, around which the cables, hydraulic lines and/or control wires may bend to prevent detrimental pinching of them. Suitable flexible sheaths may also be deployed around the cables, hydraulic lines and/or control wires to protect them from damage.

To facilitate reduced friction between the play yard and the floor on which it rests, the play yard may be supported on wheels as shown. This expedient may reduce the power consumption as the play yard moves between collapsed and deployed positions. Instead of wheels or castors, other suitable friction reducing elements may be provide at one or more, and preferably each of, the floor-contacting locations.

In the illustrated and preferred embodiments wheels may be provided at each of the corners, but not at the central hub assembly, such that the corners may move with reduced friction as they slide across the floor, when hub assembly is moved, but the hub assembly itself does not benefit from a reduced friction between it and the floor. The frictional contact of the hub assembly against the floor may serve to prevent inadvertent movement of the play yard after it has been fully deployed and during use. Peripheral corner wheels may also facilitate rolling of the fully collapsed play yard across a floor to or from a storage location.

Another aspect of the present invention is a method for constructing the child enclosure. When constructing the FIGS. 1 and 3, enclosure embodiment, the frame base assembly is formed including the upper and the lower base legs, and the pairs of corner plates. These are assembled and attached to the hub assembly. Also attached to the base assembly are the four side posts of the side structure. The cables are attached to the cam-follower sliders and passed through the side posts. The upper assembly including the upper arms and the medial latch connectors are connected to the four side posts and the cables are attached to each upper arm and to the slide bolt nosepieces of the latch connectors. With this construction, upward and downward movement of the hub assembly, either manually or with a motor assembly, will result in the opening and folding of the frame and thereby the enclosure.

The child enclosure embodiments described in detail above, are simple, robust, easy to use, and relatively inexpensive. The various structures of the apparatus may all be made of any suitable plastics or formed of any suitable metals. Unlike the device mentioned above in the earlier patent, the embodiments disclosed herein are smoothly operated, either motor driven or manually cranked. The embodiments provide that central hub assemblies allow simultaneous movement of all movable components, pivotal corners stabilize the enclosure when in the closed or folded position, the geometry of the base legs and the cam-follower sliders are advantageously configured, as are the upper arms.

From the foregoing, it can be seen that there has been provided features for an improved child enclosure apparatus and a method of constructing the apparatus. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

The invention claimed is:

1. A foldable enclosure apparatus for a child comprising:

an upper assembly forming an upper portion of the enclosure, the upper assembly having upper arms;

a base assembly connected to the upper assembly forming a lower portion of the enclosure, the base assembly comprising four upper base legs and four lower base legs positioned underneath the upper base legs, the upper base legs and the lower base legs are positioned in an X-shaped configuration;

a side structure having a plurality of side posts connecting the upper assembly to the base assembly; and a hub assembly pivotally connected to the base assembly, wherein the operation of the hub assembly causes relative movement of the base assembly consistent with an open position and a closed position of the apparatus in response to movement of the hub assembly.

2. The apparatus of claim 1, wherein the hub assembly further comprises:

a handle for deploying the apparatus between an open position and a closed position; and a mounting structure operatively connected to the handle.

3. The apparatus of claim 2, wherein the upper and lower base legs are pivotally connected to the mounting structure.

4. The apparatus of claim 1, wherein the hub assembly is movable in a linear vertical direction such that the movement of the hub assembly causes a relative movement of the base assembly.

5. The apparatus of claim 1, wherein the hub assembly further comprises:

a handle for deploying the apparatus between an open position and a closed position;

a collar;

a mounting structure positioned below the collar; and at least one link having a first end pivotally connected to the collar and a second end pivotally connected to the upper base legs.

6. The apparatus of claim 5, wherein the lower base legs are pivotally connected to the mounting structure.

7. The apparatus of claim 5, wherein the first end of the at least one link is pivotally connected to the collar by rivets.

8. The apparatus of claim 5, wherein the second end of the at least one link is pivotally connected to the upper base legs by rivets.

9. The apparatus of claim 1, wherein the upper assembly further comprises one or more latch connectors.

10. A foldable enclosure apparatus for a child, comprising:

an upper assembly having a plurality of upper arms;

a base assembly having a plurality of upper base legs and lower base legs;

a side structure having a plurality of side posts connecting the upper assembly to the base assembly; and a hub assembly operatively coupled to the base assembly for moving the apparatus between a closed position and an open position, wherein the hub assembly comprises a handle for deploying the apparatus between an open position and a closed position;

an upper structure operably connected to the handle and comprising a collar;

a shaft extending through the collar;

a lower structure operably connected to the upper structure by the shaft; and at least one link having a first end pivotally connected to the collar and a second end pivotally connected to at least one of the upper base legs.

11. The apparatus of claim 10, wherein at least one of the plurality of upper base legs are pivotally connected to the lower structure.

12. The apparatus of claim 10, wherein the hub assembly is centrally located with respect to the base assembly.

13. The apparatus of claim 10, wherein the hub assembly is movable in a linear vertical direction such that the movement of the hub assembly causes a relative movement of the base assembly.

14. The apparatus of claim 10, wherein the upper assembly further comprises one or more latch connectors.

15. The apparatus of claim 10, wherein the operative structure is a cable having a first end connected to a cam and follower mechanism on the base structure and a second end connected to the upper assembly.

16. The apparatus of claim 10, wherein the lower base legs are pivotally connected to the lower structure and the upper assembly, the base assembly, the side structure, and the hub assembly are moveable between an open position and a closed position.

* * * * *